US008433216B2

(12) United States Patent
Ishikake et al.

(10) Patent No.: US 8,433,216 B2
(45) Date of Patent: Apr. 30, 2013

(54) IMAGE FORMING APPARATUS

(75) Inventors: Satoru Ishikake, Kanagawa (JP); Masanori Kawasumi, Kanagawa (JP); Hideyo Watanabe, Kanagawa (JP); Yosuke Saito, Kanagawa (JP); Hirokatsu Suzuki, Kanagawa (JP); Hiroki Atari, Kanagawa (JP); Kimie Toda, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 288 days.

(21) Appl. No.: 12/985,597

(22) Filed: Jan. 6, 2011

(65) Prior Publication Data

US 2011/0164895 A1 Jul. 7, 2011

(30) Foreign Application Priority Data

Jan. 7, 2010 (JP) ..... 2010-002112
Jan. 7, 2010 (JP) ..... 2010-002117
Jan. 7, 2010 (JP) ..... 2010-002121

(51) Int. Cl.
*G03G 15/00* (2006.01)

(52) U.S. Cl.
USPC ..... 399/88

(58) Field of Classification Search ..... 399/88, 399/81, 82, 85
See application file for complete search history.

(56) References Cited

U.S. PATENT DOCUMENTS

2009/0185049 A1* 7/2009 Takahashi ..... 348/222.1

FOREIGN PATENT DOCUMENTS

| | | |
|---|---|---|
| JP | 2001-235920 | 8/2001 |
| JP | 2004-341947 | 12/2004 |
| JP | 2005-342951 | 12/2005 |
| JP | 3786274 | 3/2006 |
| JP | 2006-138930 | 6/2006 |
| JP | 2007-43569 | 2/2007 |
| JP | 3977273 | 6/2007 |
| JP | 3977274 | 6/2007 |
| JP | 2007-286410 | 11/2007 |
| JP | 4341807 | 7/2009 |
| JP | 2010-92013 | 4/2010 |

* cited by examiner

*Primary Examiner* — Quana M Grainger
(74) *Attorney, Agent, or Firm* — Oblon, Spivak, McClelland, Maier & Neustadt, L.L.P.

(57) ABSTRACT

An image forming apparatus that has a monochrome mode and a full color mode as image forming modes, includes: a power supply unit configured to supply power thereto; a main power switch configured to turn on and off the power supply unit; a mode switching unit configured to selectively and manually be switched between the monochrome mode and the full color mode, wherein the main power switch and the mode switching unit are integrally formed as one mode switch; a power supply interrupting unit configured to interrupt power supply to a part that is necessary to form an image in a mode other than the monochrome mode, when the mode switch is set to the monochrome mode.

20 Claims, 22 Drawing Sheets

IMAGE FORMING APPARATUS

CROSS-REFERENCE TO RELATED APPLICATIONS

The present application claims priority to and incorporates by reference the entire contents of Japanese Patent Application No. 2010-002117 filed in Japan on Jan. 7, 2010, Japanese Patent Application No. 2010-002112 filed in Japan on Jan. 7, 2010 and Japanese Patent Application No. 2010-002121 filed in Japan on Jan. 7, 2010.

BACKGROUND OF THE INVENTION

1. Field of the Invention

The present invention relates to an image forming apparatus such as a multifunction printer that includes a copying machine, a printer, a facsimile, and a plotter or includes at least one of them.

2. Description of the Related Art

While the demand on energy saving has been increased in recent years, there is a demand on the reduction in power consumption of an image forming apparatus. In particular, full color printing consumes a large amount of toner and uses large number of drive units. Accordingly, large power is required in the full color printing as compared with printing a black image (monochrome mode).

Japanese Patent Application Laid-open No. 2006-138930 discloses a method of printing in which a document image is detected and switching between color and monochrome outputs is automatically performed, in order to provide an image forming apparatus, which reliably saves expensive expendable supplies such as toner or ink and produces a copy as intended by a simple operation.

Further, in addition to an automatic mode switching means, provided is a preferential mode switching means, which forcibly switches it's mode to a monochrome mode in preference to the switching performed by the automatic mode switching means. The turning on and off of the preferential mode switching means are performed through an operation panel.

In Japanese Patent Application Laid-open No. 2004-341947, there is disclosed a structure where the surface of a main power switch is covered with a cover so as for an unnecessary operation of a switch not to be performed.

As in the method disclosed in Japanese Patent Application Laid-open No. 2006-138930, if the switching between a color mode and a monochrome mode is performed with the use of the operation panel or on the basis of the result from the detection of the document, it is natural that the switching between the color mode and the monochrome mode be performed according to the type of a document on all occasions.

Accordingly, the apparatus must always be ready to perform color output. For this purpose, correction of positional deviation among colors or density adjustment for each color should be always ensured.

Meanwhile, usually, most of output images are monochrome images and color outputs are only a little. That is to say, the color image forming apparatus in the related art frequently has performed correction of positional deviation of each color or density adjustment for each color, for the purpose of producing a little color outputs.

It takes time to perform the correction of positional deviation or density adjustment; and a machine cannot be used during that time. Further, such adjustment consumes toners of respective colors and requires driving of image forming units corresponding to respective colors. This incurs toner consumption and degradation of components of the units resulting from frequent driving of the units, and causes an increase in power consumption. Moreover, those are unexpectedly considerable.

Particularly, in recent years, a color product-printing machine, which enables mass production of outputs, has been proposed instead of an offset printing machine. However, in this field, there has been a strong demand on lengthening the life spans of components of each unit; reduction in toner and power consumption; and reduction in time during which a machine cannot be used to perform correction of positional deviation, as compared with the past.

SUMMARY OF THE INVENTION

It is an object of the present invention to at least partially solve the problems in the conventional technology.

According to an aspect of the present invention, an image forming apparatus that has a monochrome mode and a full color mode as image forming modes, comprising: a power supply unit configured to supply power thereto; a main power switch configured to turn on and off the power supply unit; a mode switching unit configured to selectively and manually be switched between the monochrome mode and the full color mode, wherein the main power switch and the mode switching unit are integrally formed as one mode switch; a power supply interrupting unit configured to interrupt power supply to a part that is necessary to form an image in a mode other than the monochrome mode, when the mode switch is set to the monochrome mode.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments of the invention will be described below.

First Embodiment

First Embodiment (1)

An embodiment of the invention will be described below with reference to the drawings. A first embodiment (1) will be described with reference to FIGS. 1 to 11 and FIGS. 18 to 20.

Figure 18:
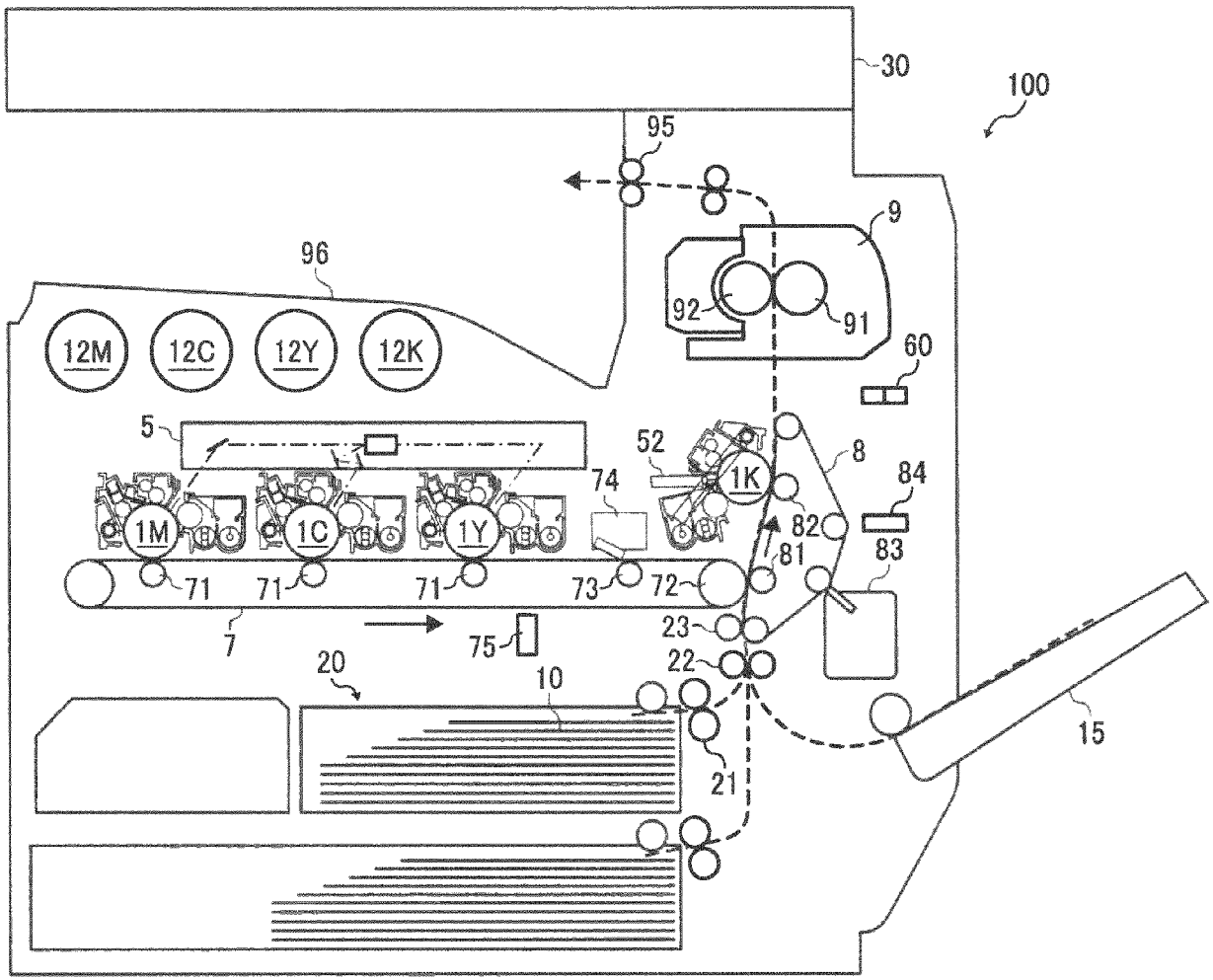
FIG. 18 is a schematic view showing the structure of an image forming apparatus.

First, the overall structure and operation of an image forming apparatus (which is common to the respective embodiments) according to this embodiment will be described with reference to FIGS. 18 to 20. As shown in FIG. 18, an image forming apparatus 100 is a tandem type image forming apparatus where three, that is, yellow, cyan, and magenta (hereinafter, abbreviated as Y, C, and M) image forming units are juxtaposed along an intermediate transfer belt 7 serving as an intermediate transfer body. A transfer material conveying belt 8 serving as a transfer material conveying unit is installed being in contact with the intermediate transfer belt 7.

The three, that is, Y, M, and C image forming units and the intermediate transfer belt 7 are "portions that are necessary to form images in a mode other than a monochrome mode."

A black (K) image forming unit serving as a monochrome image producing unit is independently provided at a relatively downstream position from a contact position (secondary transfer portion), where the transfer material conveying belt 8 and the intermediate transfer belt are in contact with each other, in the moving direction of a recording sheet (which is called a recording medium, a transfer material, or a transfer sheet) 10. The black image forming unit is disposed so that an image of the black image forming unit is directly transferred to the recording sheet.

Figure 19:
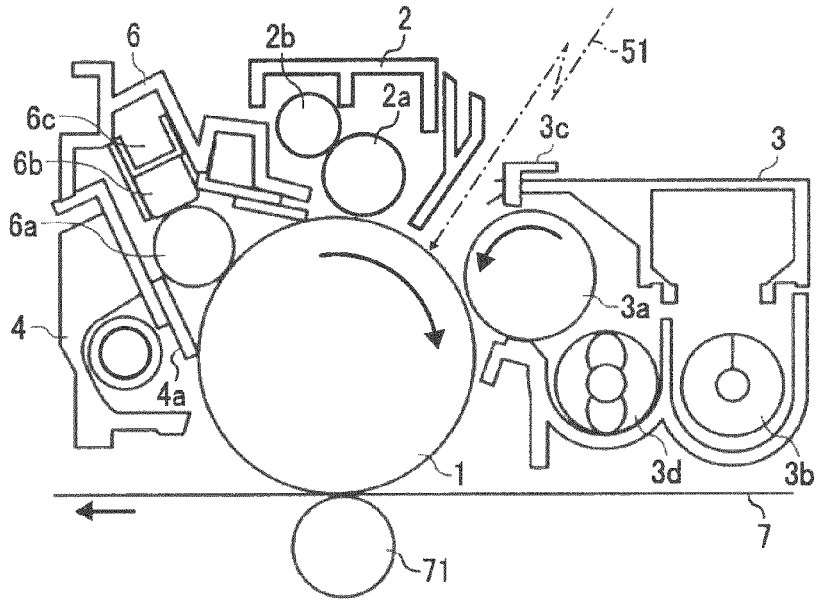
FIG. 19 is a view showing the structure of a color image producing unit.

FIG. 19 shows a color image forming unit that is used for any of yellow, cyan, and magenta. Since the color image forming units have the same structure, the symbols of Y, C, and M used to distinguish colors will be not described with reference to FIG. 19. Each of the color image forming units includes a photosensitive element 1 that is a latent image carrier, a charging unit 2 that applies an electric charge to the surface of the photosensitive element 1, an exposing unit 5 that forms a latent image by emitting exposure light 51 from a light source, such as a laser and an LED array, a developing device 3 that forms a toner image by supplying a toner to the latent image, a cleaning unit 4 that cleans the surface of the photosensitive element 1 after the transfer of the toner image, and a lubricant applying unit 6 that applies a lubricant to the surface of the photosensitive element 1.

The charging unit 2 includes a charging roller 2*a* and a cleaning roller 2*b*. The developing device 3 includes a developing roller 3*a*, developer stirring-conveying members 3*b* and 3*d*, and a doctor blade 3*c*. The cleaning unit 4 includes a cleaning blade 4*a*. The lubricant applying unit 6 includes a brush roller 6*a*, a solid lubricant 6*b*, and a biasing member 6*c*.

The cleaning unit 4 is a blade type cleaning unit. However, in the invention, the cleaning unit is not limited thereto and may be a fur brush roller type cleaning unit or a magnetic brush type cleaning unit. These are integrated to form a process cartridge, and the process cartridge is detachably mounted on the image forming apparatus.

Figure 20:
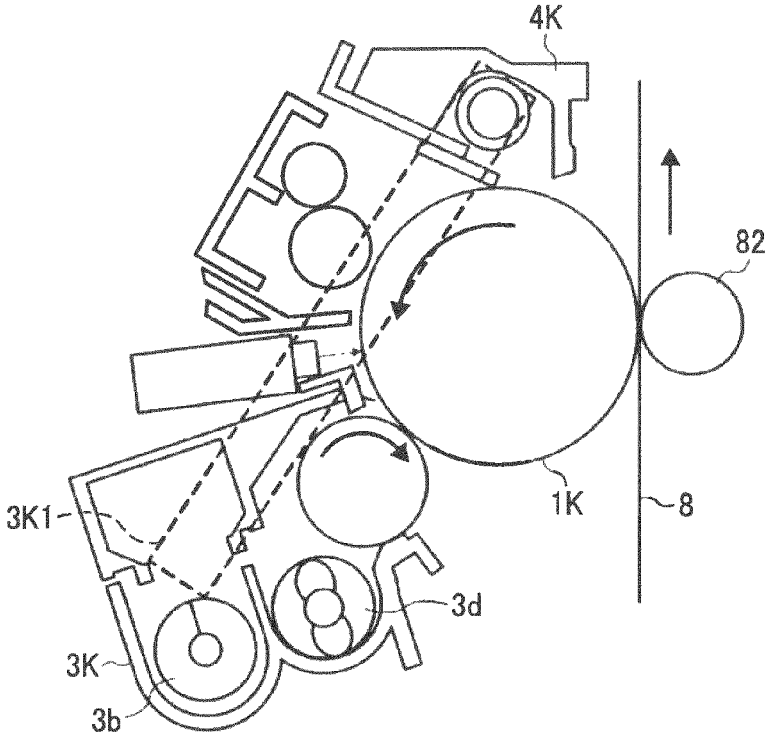
FIG. 20 is a view showing the structure of a monochrome image producing unit.

FIG. 20 shows a color image forming unit used for black (hereinafter, referred to as a "monochrome image producing unit" so as to be distinguished from the Y, M, and C color image forming units). Meanwhile, the Y, M, and C color image forming units, the intermediate transfer belt 7, and the drive structure thereof are collectively referred to as the "color image producing units."

The structure of the monochrome image producing unit is different from that of each of the Y, M, and C color image forming units in that the monochrome image producing unit does not include the lubricant applying unit but includes a recycled toner conveying member 3K1 for connecting a developing device 3K to a cleaning unit 4K.

It may be possible to reuse black toner by supplying a black toner, which is collected in the cleaning unit 4K by the recycled toner conveying member 3K1, to the developing device 3K again. A conveying coil and the like may be provided in the recycled toner conveying member 3K1.

The operation (full color mode) of the image forming apparatus 100 will be described with reference to FIG. 18.

A document which is read by a scanner 30, data which is received by a facsimile or the like, or color image information which is sent from a computer is separated into respective colors, that is, yellow, cyan, magenta, and black (hereinafter, abbreviated as Y, C, M, and K), so that print data corresponding to the respective colors are formed. The print data are sent to the exposing units 5 of the image forming units corresponding to the respective colors.

Portions of the uniformly charged photosensitive elements 1, on which images are formed, are exposed by the exposing unit 5; and toner images are formed by the developing devices 3. Meanwhile, exposure corresponding to K is performed by an independent exposing unit 52, but may be also performed by the exposing unit 5.

Primary transfer rollers 71 are disposed at positions, which oppose the respective color photosensitive elements 1 with the intermediate transfer belt 7 interposed therebetween, respectively. The primary transfer rollers 71 primarily transfer the toner images, which are formed on the photosensitive elements 1, to the intermediate transfer belt 7. The primary transfer rollers 71 are connected to a power source (not shown), and a predetermined voltage is applied to the primary transfer rollers. Accordingly, the color toner images formed on the photosensitive elements 1Y, 1C, and 1M are transferred onto the intermediate transfer belt 7 at an appropriate timing, and the color toner images of which the colors are superimposed are formed on the intermediate transfer belt 7.

The outside of a portion of the intermediate transfer belt 7, the portion being supported by a roller 72, is in contact with the transfer material conveying belt 8 due to a roller 81 that is positioned inside the transfer material conveying belt 8. The roller 81 is connected to a power source (not shown), and a predetermined voltage is applied to the roller 81. The roller 72 may be applied with a voltage.

A feeding device 20 and a pick-up roller 21 are provided at a lower portion of a main body of the image forming apparatus. Transfer sheets 10 are placed in the feeding device 20; and the feeding device 20 feeds the transfer sheet 10 to the secondary transfer portion (contact portions of the transfer material conveying belt 8 and the intermediate transfer belt 7 that is in contact with each other). A transfer sheet is fed to a pair of resist rollers 22 and is stopped. However, the transfer sheet is fed onto the transfer material conveying belt 8 at a predetermined timing by the rotation of the pair of resist rollers 22. The transfer sheet is adsorbed onto the transfer material conveying belt 8 by an adsorbing roller 23 to which a voltage is applied, and is conveyed to a contact position where the transfer material conveying belt and the intermediate transfer belt 7 are in contact with each other.

The color toner images formed on the intermediate transfer belt 7 are transferred to the transfer sheet 10 at the contact portions of the intermediate transfer belt 7, which is interposed between the rollers 72 and 81, and the transfer material conveying belt 8.

An intermediate transfer belt cleaning unit 74, which cleans the surface of the intermediate transfer belt 7 after the secondary transfer, is provided outside the portion of the intermediate transfer belt 7 that is supported by a roller 73.

A roller 82, which is positioned inside the transfer material conveying belt 8 at a position opposing a black photosensitive element 1K, is connected to a power source (not shown) and a predetermined voltage is applied to the roller 82. Accordingly, a black toner image formed on the photosensitive element 1K is directly transferred onto the recording sheet 10 which is conveyed by the transfer material conveying belt 8 and on which the color images have been formed. The conveyance surface of the transfer material conveying belt 8 is cleaned by a transfer material conveying belt cleaning unit 83.

A fixing device 9 is provided above the transfer material conveying belt 8 (on the upstream side in a sheet conveying direction). The fixing device 9 semipermanently fixes the toner images which have been transferred to the transfer sheet. The fixing device 9 includes a pressing roller 92 and a fixing roller 91 having a halogen heater inside thereof. The pressing roller and the fixing roller oppose each other and are in pressure-contact with each other. The toner images pass through a contact area where the pressing roller and the fixing roller are in press-contact with each other, so that the toner images transferred to the transfer sheet are fixed; and a color image is formed. The transfer sheet 10 to which the color image has been fixed is discharged out to a discharging unit 96, which is positioned in a space below the scanner 30 (a space in the body) and forms an upper surface of the image forming apparatus, by a pair of discharging rollers 95.

In FIG. 18, toner tanks (toner bottles) 12Y, 12M, 12C, and 12K supply toners to the developing devices 3 corresponding to the respective colors.

Next, an image forming operation in the monochrome mode will be described.

The portion of the photosensitive element 1K on which an image is formed is exposed by the exposing unit 52 on the basis of the data of a black image which is read, and a toner image is formed by the developing device 3K. The toner image is directly transferred to the recording sheet 10 that is conveyed by the transfer material conveying belt 8, and is fixed by the fixing device 9. As a result, a monochrome image is formed.

Meanwhile, during the production of the monochrome image, the contact between the intermediate transfer belt 7 and the transfer material conveying belt 8 is loosened by a certain mechanism (not shown) so that the contact portions of the intermediate transfer belt 7 and the transfer material conveying belt 8 are canceled. The respective Y, C, and M image forming units and the intermediate transfer belt 7 are not operated. Accordingly, it may be possible to lengthen the life span of each of the Y, C, and M image forming units and the intermediate transfer belt 7.

In FIG. 18, optical sensors 75 and 84 detect the density of a toner image. The optical sensor 75 is disposed at positions opposing the intermediate transfer belt 7. They are also disposed at positions which are on more downstream side than the most downstream photosensitive element among the photosensitive elements opposing the intermediate transfer belt, but on more upstream side than a contact portion of the intermediate transfer belt 7 and the transfer material conveying belt 8.

A plurality of optical sensors 75 are installed in the width direction (main-scanning direction) orthogonal to the moving direction of the intermediate transfer belt 7. In this embodiment, as described below, the optical sensors are mounted at three positions, that is, a middle position, a left position, and a right position in the width direction of the intermediate transfer belt 7. The optical sensor 75 includes a light emitting portion and light receiving portions. The optical sensor detects light, which is emitted from the light emitting portion and is reflected from the intermediate transfer belt 7, by the light receiving portions. Here, the optical sensor includes two light receiving portions, which can receive two kinds of reflected light, that is, regularly reflected light and diffusive reflected light as the reflected light. Accordingly, it may be possible to calculate the amount of adhered toner for each color and detect the position of adhered toner, based on the reflection characteristics.

The amount of adhered toner corresponding to Y, C, and M, which are color stations, and the amount of positional deviation can be detected by the optical sensors 75.

Meanwhile, the optical sensors 84 are disposed at positions that oppose the transfer material conveying belt 8 and are disposed on the more downstream side than the contact position of the intermediate transfer belt 7 and the transfer material conveying belt 8.

A plurality of optical sensors 84 are installed in the width direction (main-scanning direction) orthogonal to the moving direction of the transfer material conveying belt 8. In this embodiment, the optical sensors are mounted at three positions, that is, a middle position, a left position, and a right position in the width direction of the transfer material conveying belt. The positional deviation and the amount of adhered toner corresponding to all colors of the Y, C, M, and K stations, which are color stations, can be detected by the optical sensors 84.

In FIG. 18, a manual feed tray 15 and a mode switch 60 that has the function as a main power switch are illustrated.

The structure and function of the mode switch 60 will be described in detail below.

Figure 1A:
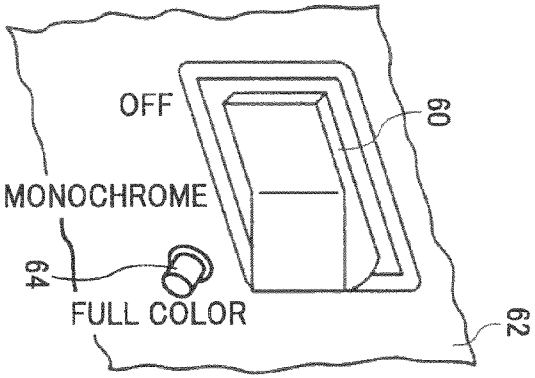
FIGS. 1A to 1C are perspective views of a mode switch according to a first embodiment (1)
Figure 1B:
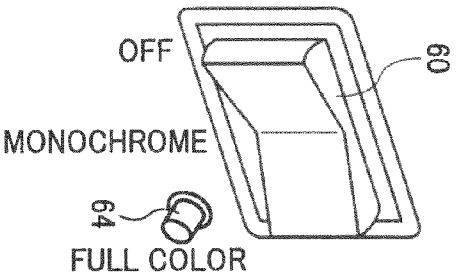
Figure 1C:
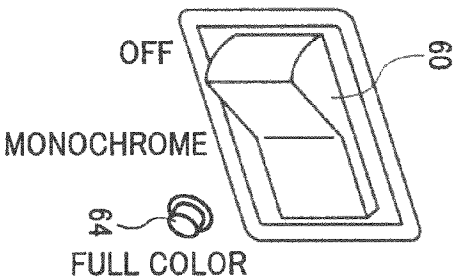

As shown in FIGS. 1A to 1C, the mode switch 60 is a hard switch where a main power switch is formed integrally with a mode switching unit for selectively and manually switching a mode between a monochrome mode and a full color mode.

Figure 10:
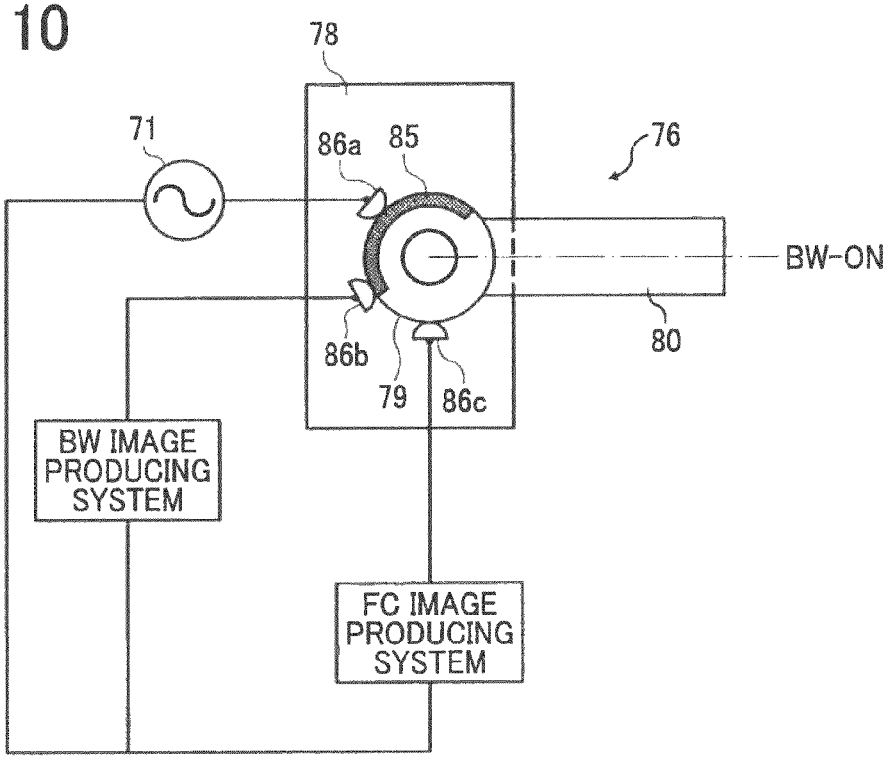
FIG. 10 is a schematic longitudinal-sectional view illustrating the toggle type mode switch that is set to the power-off mode position.

FIG. 1A shows a state where a left portion of the mode switch 60 is pushed in; and this state corresponds to a power-off mode position that is the same as the OFF position of a main power switch in the related art. FIG. 1B shows a monochrome mode position, and the monochrome mode position is a power-on mode position. FIG. 10 shows a full color mode position, and the full color mode position is also a power-on mode position.

In FIG. 1A, an apparatus-side plate 62 (which is not shown in FIGS. 1B and 1C) is also provided, and a lock release button 64 is operated when the mode switch is switched to the full color mode position from the monochrome mode position.

In order to switch the mode switch to the monochrome mode position from the power-off mode position, only the right portion of the mode switch 60 may be pushed. In order to switch the mode switch to the full color mode position from the monochrome mode position, the right portion of the mode switch 60 should be pushed at the same time the lock release button 64 is pushed. That is, the switching of the mode switch to the full color mode position from the monochrome mode position requires two or more operations so that there is no likelihood that an operator set the mode switch to a full color mode by mistake when the mode switch should be set to a monochrome mode.

Figure 2:
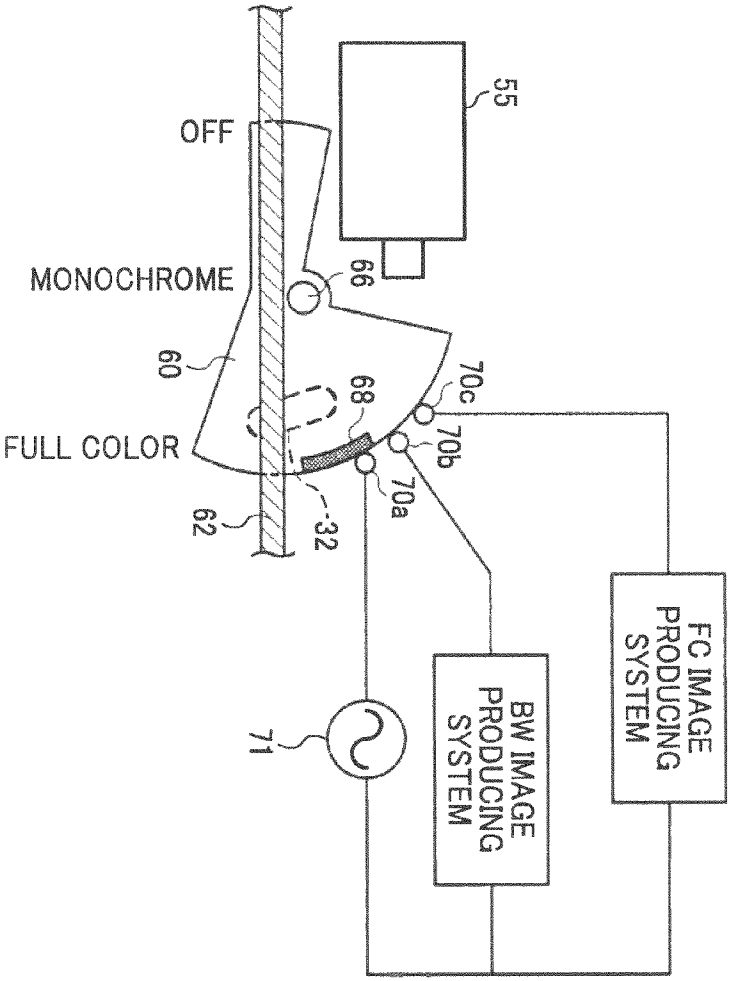
FIG. 2 is a schematic cross-sectional view showing a state where the mode switch is set to a power-off mode position.

As shown in FIG. 2, the mode switch 60 is rotatably supported on the apparatus-side plate 62 by a shaft 66 through a bracket (not shown) and is positioned at each of the set positions by snap-fitting manner.

A portion of the mode switch corresponding to the full color mode position has the shape of a fan and is thick; and a conductive portion 68 is formed on the peripheral surface of the mode switch corresponding to the full color mode position. Connecting terminals 70*a*, 70*b*, and 70*c* are provided at a portion of the main body of the image forming apparatus facing the conductive portion 68; and the conductive portion 68 is long enough to electrically connect the connecting terminal 70*a* to the connecting terminal 70*c*.

When the connecting terminals 70*a* and 70*b* are electrically connected to each other, power is supplied only to the monochrome image producing unit (a BW image producing system) necessary for the printing in a monochrome mode; and the power supply to portions that are necessary to form an image in a mode other than the monochrome mode, that is, the color image producing units and the intermediate transfer belt 7 is interrupted. A power source 71 is also provided.

Further, when the mode switch is set to a monochrome mode, the linear speed of a sheet is set to be higher than that of a sheet in a full color mode; and a target fixing temperature is set to be lower than that in a full color mode.

When the connecting terminals 70*a* and 70*c* are electrically connected to each other, power is supplied to a full color image producing unit (a BW image producing system+a FC image producing system). Here, the "FC image producing system" means a color image producing unit for Y, M, and C colors other than black. A solenoid 55 serving as a monochrome mode automatic switching unit that automatically switches the mode switch to a monochrome mode position from the full color mode position.

Figure 3A:
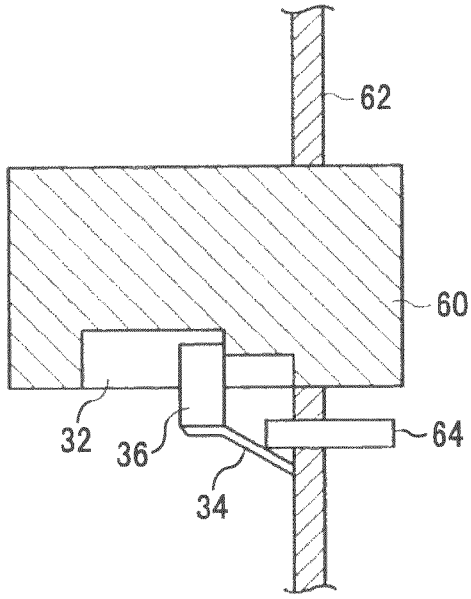
FIGS. 3A and 3B are views illustrating an operation process when the mode switch is switched to a full color mode position from a monochrome mode position.
Figure 3B:
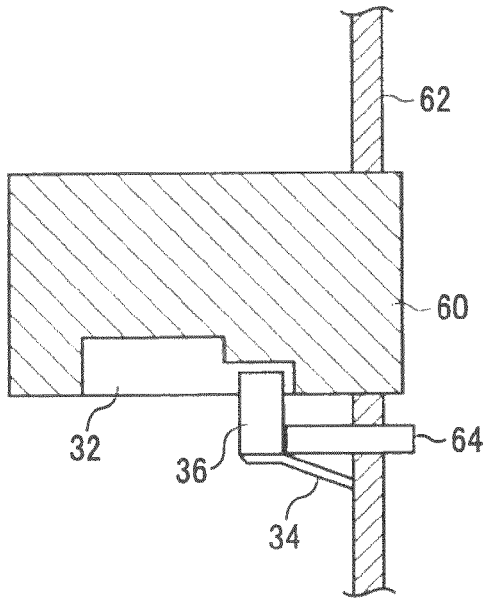

As shown in FIGS. 3A and 3B, a groove 32 having a stepped portion is formed on the lower surface of the fan-like portion of the mode switch 60; and a pin 36, of which one end is fixed to the free end of an elastic plate 34 supported by the apparatus-side plate 62, is engaged with the groove 32.

Since the pin 36 bumps against the stepped portion of the groove 32 at the monochrome mode position, the mode switch 60 cannot be pushed into as it is. When the lock release button 64 is pushed at the monochrome mode position, as shown in FIG. 3B, the elastic plate 34 is bent down and the pin 36 is displaced downward. Accordingly, the pin passes through the stepped portion, so that the mode switch can be set to the full color mode position. The lock release button 64 is biased by a spring (not shown) so as to always protrude toward the surface (operation surface) of the apparatus-side plate 62.

Since two or more different operations are required to switch the mode switch to the full color mode from the black mode, it may be possible to prevent an operator from setting the mode switch to the full color mode without intention when power is supplied.

FIG. 2 shows a state where the mode switch 60 is set to a power-off mode position. This state corresponds to a power-off state of a main power switch in the related art.

Figure 4:
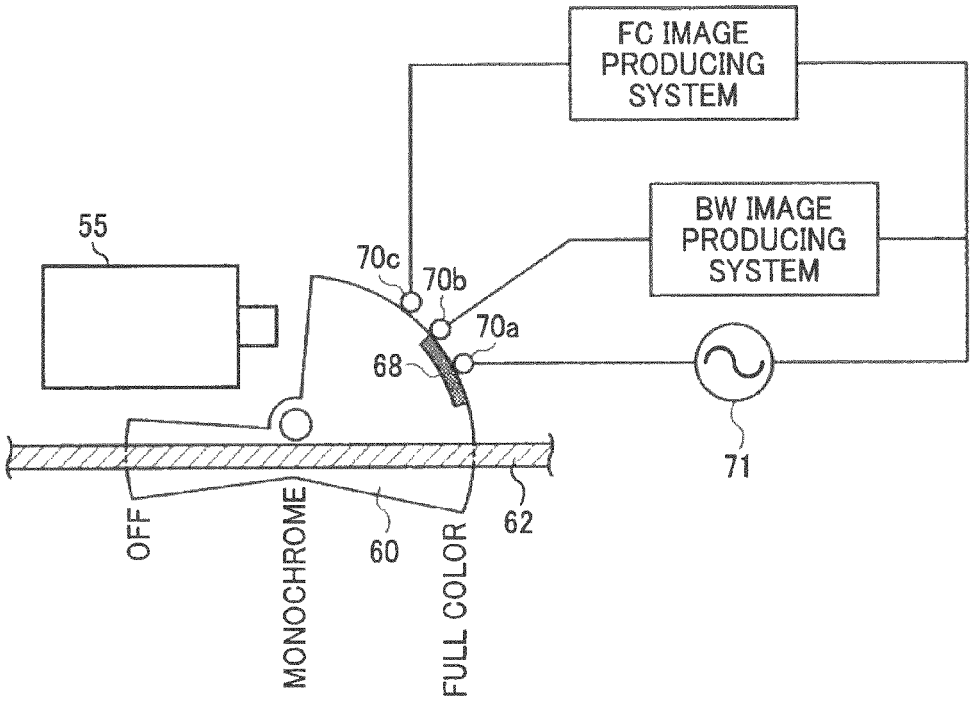
FIG. 4 is a schematic cross-sectional view showing a state where the mode switch is set to a monochrome mode position.

When the mode switch 60 is set (switched) to a monochrome mode position, the connecting terminals 70*a* and 70*b* are electrically connected to each other by the conductive portion 68 as shown in FIG. 4, the power is supplied to only the monochrome image producing unit (the BW image producing system) necessary for the printing in a monochrome mode, and the power supply to portions that are necessary to form an image in a mode other than a monochrome mode is interrupted. Accordingly, it may be possible to manage the power, which is supplied to the monochrome image producing unit and the color image producing unit, by the mode switch 60.

Specific description will be provided on the basis of the structure of the image forming apparatus. When the mode switch 60 is set to a monochrome mode, the supply of power for driving the three of the Y, M, and C image forming units, the intermediate transfer belt 7, and the like is interrupted. The adjustment of the positional deviation of each color, the adjustment of the density of other images other than a black image, or the like is not performed in a monochrome mode. Accordingly, it may be possible to reduce power consumption caused by an unnecessary operation, or the consumption of toner other than black toner.

Figure 5:
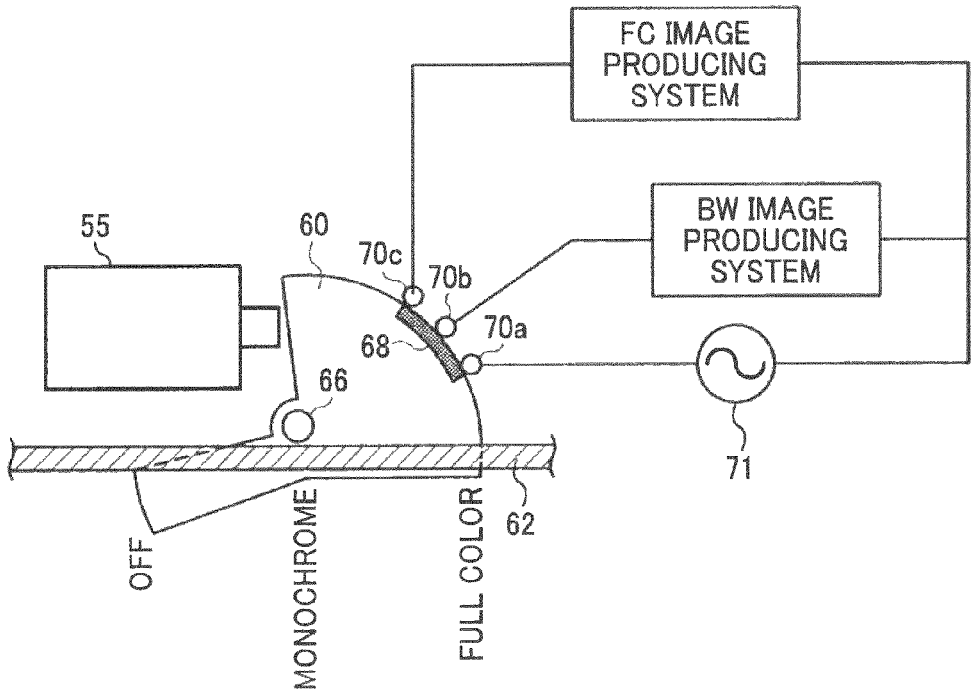
FIG. 5 is a schematic cross-sectional view showing a state where the mode switch is set to a full color mode position.

When the mode switch 60 is set to a full color mode position as shown in FIG. 5, power is supplied to the BW image producing system and the FC image producing system as in an ON state of the main power switch in the related art.

The adjustment of the positional deviation of each color, the adjustment of the density of images (process control), or the like are regularly performed in a full color mode as in the image forming apparatus in the related art.

Figure 6:
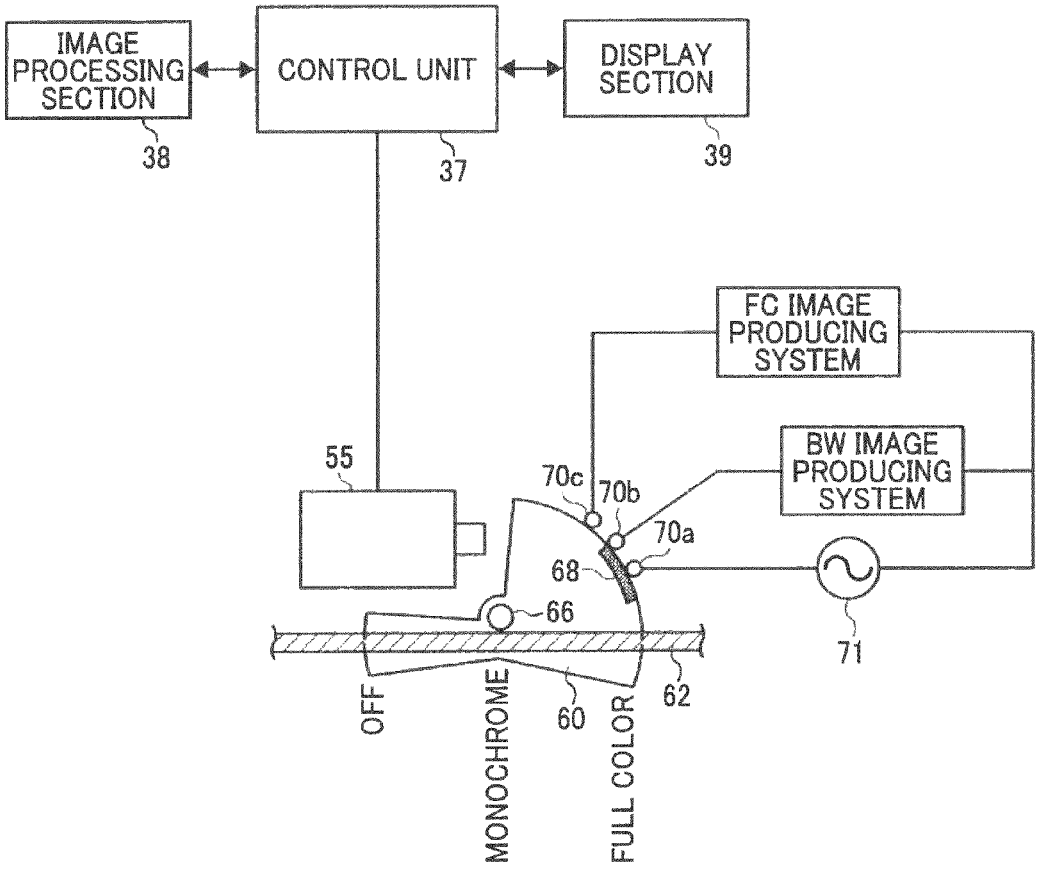
FIG. 6 is a block diagram of a control system when a monochrome mode automatic switching unit is driven.

As shown in FIG. 6, when printing in a full color mode is completed and when a full color printing rate exceeds a predetermined value, the mode switch is set to be forcibly switched to the monochrome mode from the full color mode.

A full color printing rate is decided as a ratio of the number of sheets, which are printed in a full color mode, to the total number of printed sheets. Whether a full color printing rate exceeds a predetermined value or not is determined by a control unit 37. The control unit 37 is a microcomputer that includes a CPU, an I/O interface, a ROM, a RAM, and the like. The control unit 37 can find out which position the mode switch 60 is set to, by a position sensor or a connection circuit (not shown).

When a full color printing rate exceeds a predetermined value, the control unit 37 forcibly sets the mode switch 60 to a monochrome mode position by driving the solenoid 55. Since the locking caused by the stepped portion of the groove 32 does not occur when the mode switch is switched to a monochrome mode position from a full color mode position, it may be possible to switch the mode switch to a monochrome mode position from a full color mode position by one kind of operation (a push-in operation using the solenoid 55).

Accordingly, it may be possible to prevent the increase in costs that is caused by the increase of printing in a full color mode while a user is not aware of the increase of the printing in a full color.

A full color printing rate may be decided on the basis of the information on image data sent from an image processing section 38.

When a printing job in a full color mode is completed, the control unit 37 automatically switches the mode switch to a monochrome mode from a full color mode by driving the solenoid 55 as described above. Accordingly, it may be possible to reliably switch the mode switch to a monochrome mode from a full color mode, and to usually set the mode switch to a monochrome mode whose printing rate is generally large.

That is, it may be possible to suppress unintended misprint in a full color mode when an operator starts printing without being aware of mode setting.

Further, the control unit 37 makes a display section 39 display which mode of a power-off mode, a monochrome mode, and a full color mode the image forming apparatus 100 is set to, so that an operator can visually and easily confirm which mode of a power-off mode, a monochrome mode, and a full color mode the image forming apparatus 100 is set to. The display section 39 may be a liquid crystal display section of an operation panel (not shown), or may be color indication lamps that are fixed to the outer surface of the main body of the image forming apparatus. Accordingly, it may be possible to easily provide mode information when an operator requests print.

Figure 7A:
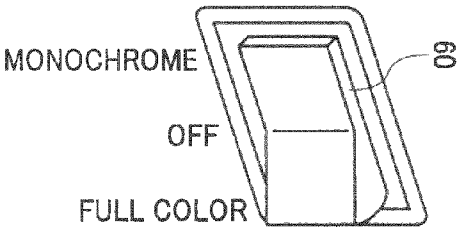
FIGS. 7A to 7C are views showing a modification of the mode switch.
Figure 7B:
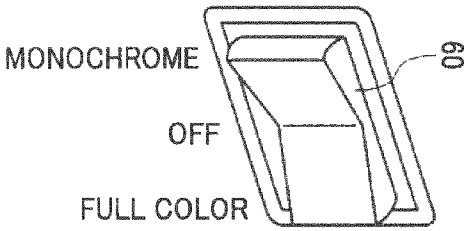
Figure 7C:
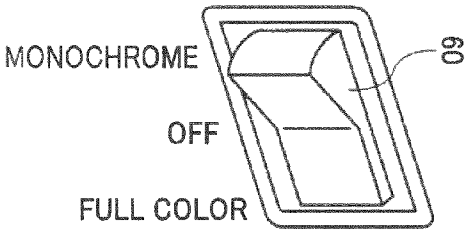

As shown in FIGS. 7A to 7C, a position between a monochrome mode position and a full color mode position is referred to as a power-off mode position. When the mode switch is switched to a full color mode from a monochrome mode and when the mode switch is switched to a monochrome mode from a full color mode, the mode switch may be switched via the power-off mode position therebetween.

FIG. 7A shows a state where the mode switch is set to a monochrome mode position, FIG. 7B shows a state where the mode switch is set to a power-off mode position, and FIG. 7C shows a state where the mode switch is set to a full color mode position.

According to this, the mode switch needs to be operated in an opposite direction in a monochrome mode and a full color mode when power is supplied in a power-off mode. Accordingly, the mode switch can be adapted so that a monochrome mode and a full color mode are intentionally selected. The lock release button 64 is not provided in the structure shown in FIGS. 7A to 7C.

Figure 8A:
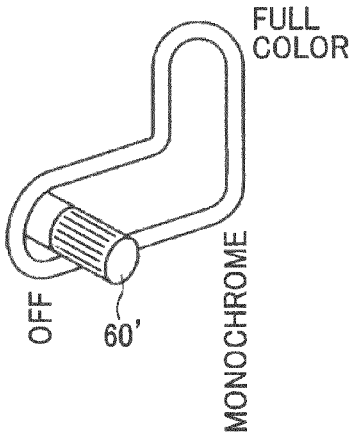
FIGS. 8A to 8C are views showing another modification of the mode switch.
Figure 8B:
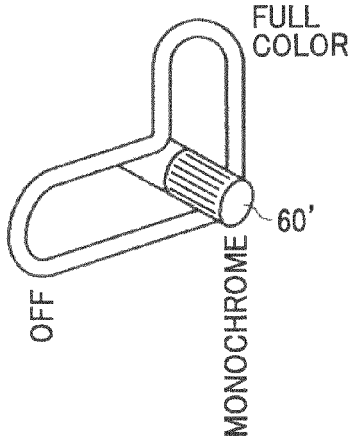
Figure 8C:
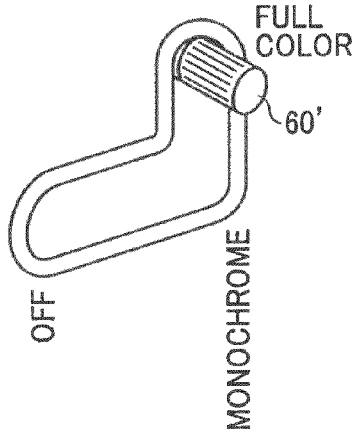

For the prevention of the unintended mode setting, as shown in FIGS. 8A to 8C, a knob-like mode switch 60' may be provided; and the switching of the mode switch to a full color mode position from a monochrome mode position is performed so that the operation direction of the mode switch is changed.

FIG. 8A shows a state where the mode switch is set to a power-off mode position, FIG. 8B shows a state where the mode switch is set to a monochrome mode position, and FIG. 8C shows a state where the mode switch is set to a full color mode position.

Figure 9:
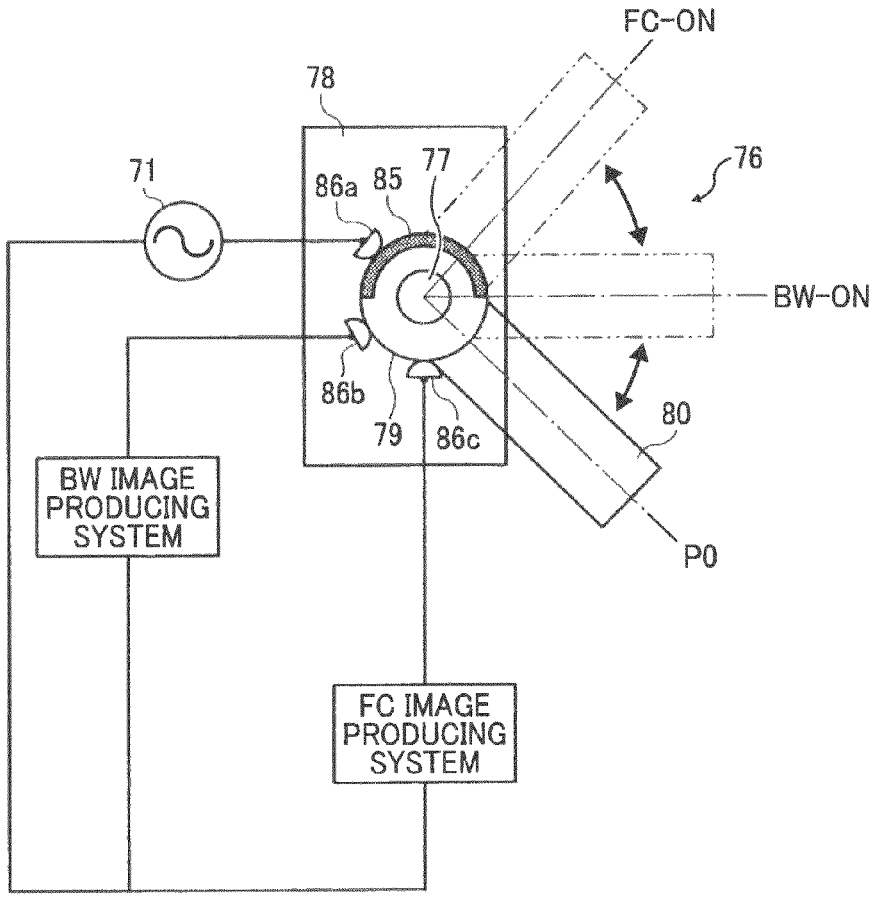
FIG. 9 is a view showing a toggle type mode switch, and is a schematic longitudinal-sectional view illustrating the toggle type mode switch that is set to a power-off mode position.
Figure 11:
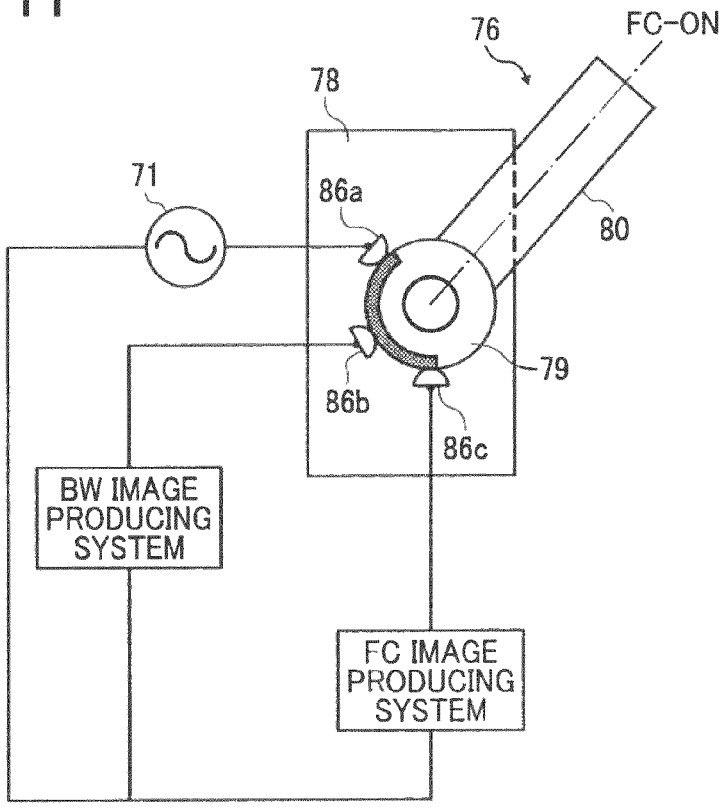
FIG. 11 is a schematic longitudinal-sectional view illustrating the toggle type mode switch that is set to a full color mode position.

A toggle type mode switch may be used as the mode switch as shown in FIGS. 9 to 11.

As shown in FIG. 9, a mode switch 76 includes a cylindrical part 79 that is rotatably provided at an apparatus-side plate 78 by a shaft 77, and an operational part 80 that is operated in a vertical direction. The cylindrical part 79 is provided with a conductive portion 85, and the apparatus-side plate 78 is provided with connecting terminals 86*a*, 86*b*, and 86*c*. The conductive portion 85 is long enough to electrically connect the connecting terminal 86*a* to the connecting terminal 86*c*.

FIG. 9 shows a power-off mode position (PO), FIG. 10 shows a monochrome mode position (BW-ON), and FIG. 11 shows a full color mode position (FC-ON).

Since the change of a power supply mode, which is caused by the mode switch 76, is the same as described above, the change of a power supply mode will be not described.

First Embodiment (2)

A first embodiment (2) will be described with reference to FIGS. 12 to 16. Meanwhile, the same components as those of the above-mentioned embodiment are denoted by the same reference numerals. As long as the structure and function of the components need not to be particularly described, the structure and function thereof will be not described and only main components will be described.

In the first embodiment (1), the mode switch itself directly has functioned as an electrical contact. However, in this embodiment, the switching position of a mode switch is detected and the mode switch is switched by a mode switching mechanism.

Figure 12:
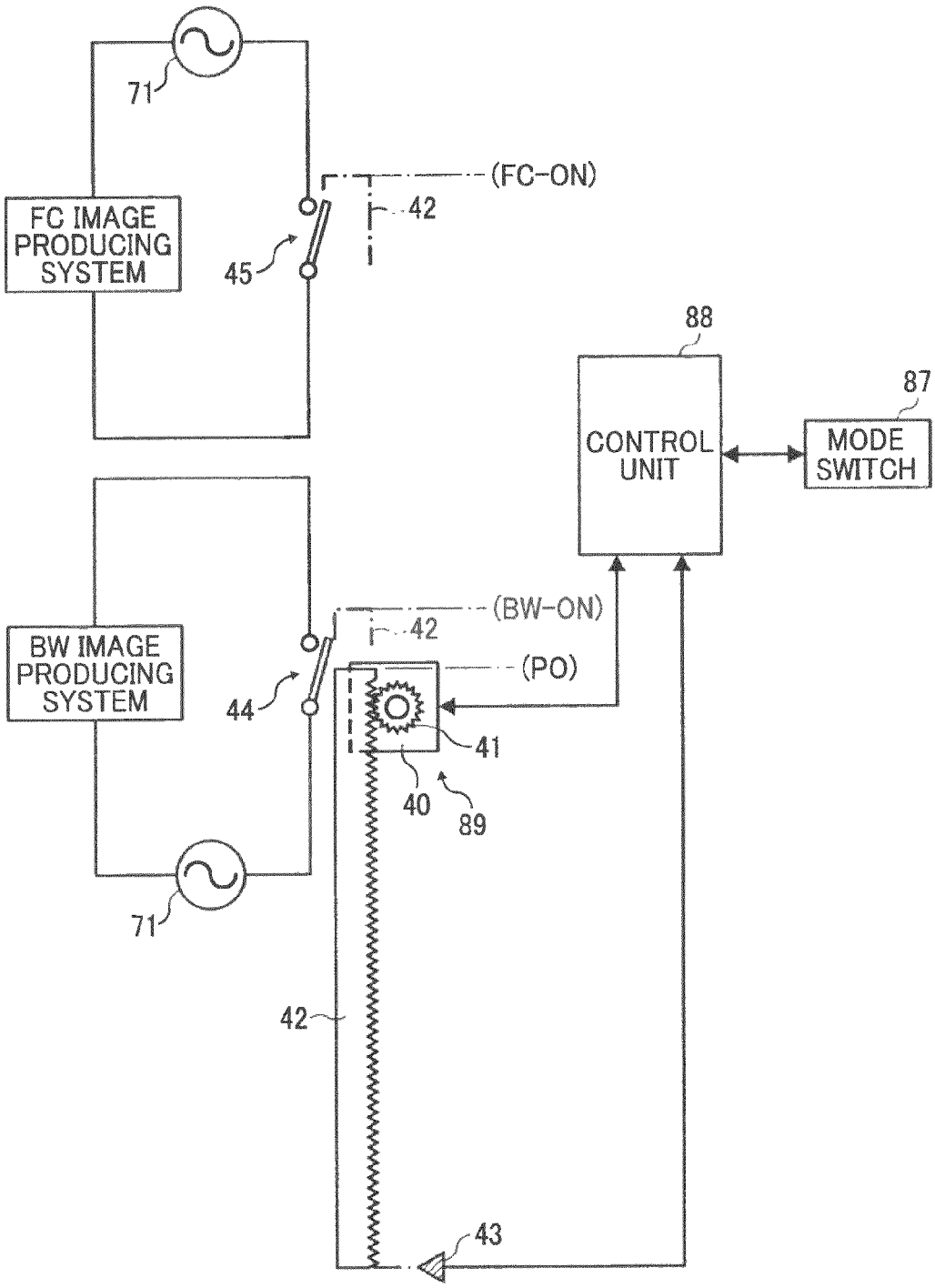
FIG. 12 is a block diagram illustrating a mode switching structure according to a first embodiment (2)

As shown in FIG. 12, a mode switch 87 of this embodiment has the same structure as the structure of each of the mode switches 60 and 76 of the above-mentioned embodiments. However, the mode switch 87 is connected to a control unit 88 without being connected to the color image producing unit and a monochrome image producing unit. The control unit 88 can detect the switching position of the mode switch 87.

A mode switching mechanism 89 includes a stepping motor 40, a pinion 41 that is fixed to a rotating shaft of the stepping motor 40, a rack 42 that meshes with the pinion 41, and an HP sensor 43 that detects the home position of the rack 42. The rack 42 can be linearly moved by a guide (not shown).

A switch 44 of the monochrome image producing unit and a switch 45 of the color image producing unit are usually in an OFF state. When the rack 42 comes into contact with the switches and presses the switches, the switches are closed.

FIG. 12 shows a state where the mode switch 87 is set to a power-off mode position. When the mode switch 87 is set to a monochrome mode position, the control unit 88 drives the stepping motor 40 so that the rack 42 is positioned at a BW-ON (monochrome mode-ON) position. When the rack 42 is moved to a BW-ON position, the switch 44 of the monochrome image producing unit is closed and power is supplied to only the monochrome image producing unit. The power supply to the color image producing unit is interrupted. Here, each of a BW image producing system and a FC image producing system is provided with a power source 71. However, a power source, which is common to the BW image producing system and the FC image producing system, may be used for a connection structure.

When the mode switch 87 is set to a full color mode position, the control unit 88 drives the stepping motor 40 so that the rack 42 is positioned at a FC-ON (full color mode-ON) position. When the rack 42 is moved to a FC-ON position, the switch 44 of the monochrome image producing unit and the switch 45 of the color image producing unit are opened together and power is supplied to all image producing units (full color image producing unit).

Next, an operation, when the mode switch 87 is switched during a printing job, will be described. During a printing job, a power supply operation, which is caused by the switching of a mode performed by the mode switch 87, delays a predetermined timing.

Control Example 1

Described first is an operation in an event in which the mode switch 87 is switched from an FC-ON position to a BW-ON position (FC-ON→BW-ON) while a full color mode printing (FC printing) job is ongoing.

Figure 13:
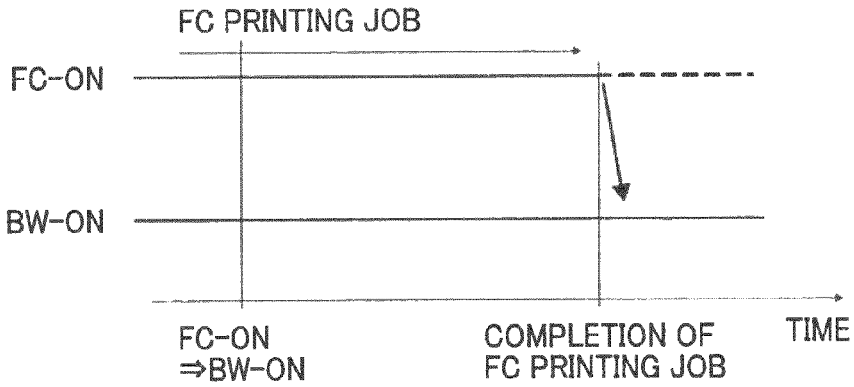
FIG. 13 is a timing chart of Control example 1 of the first embodiment (2)

As shown in FIG. 13, the control unit 88 maintains an FC-ON (full color mode ON) state until the FC printing job is finished. After the FC printing job is finished, the control unit 88 drives the stepping motor 40 so that a position of the rack 42 is changed to a BW position. As a result, a full color mode is turned off and at the same time a monochrome mode is turned on. As such, the printing mode is switched from the full color mode ON state to the monochrome mode ON state.

By the control in which the full color mode printing operation continues until the ongoing full color mode printing job is finished and thereafter a monochrome mode printing operation starts, both of quality and productivity in forming an image are not degraded but be maintained without canceling operation of a printing job.

Control Example 2

Figure 14:
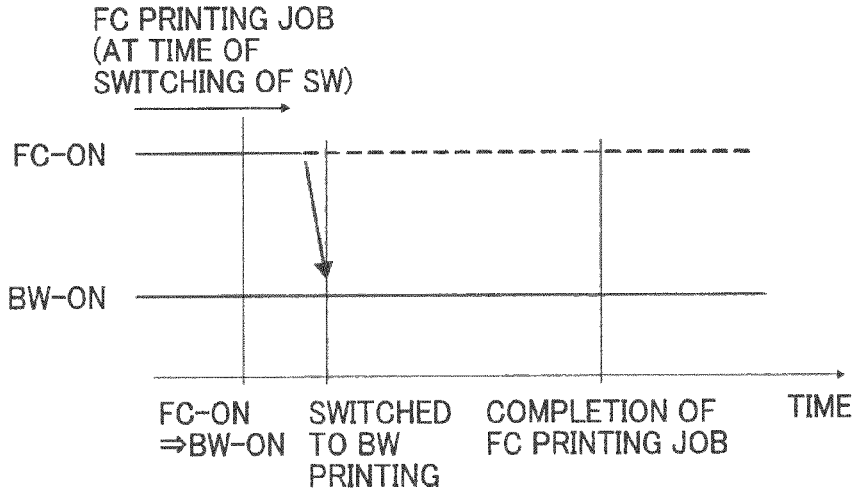
FIG. 14 is a timing chart of Control example 2 of the first embodiment (2)

If the mode switch 87 is switched from a full color mode position to a monochrome mode position (FC-ON→BC-ON) while a full color mode printing job is ongoing as shown in FIG. 14, only the ongoing printing job at the very time is to be performed in full color mode.

After completion of the ongoing printing job, the control unit turns off a full color mode and turns on a monochrome mode as described above. Then, the following printing jobs that are originally scheduled to be performed in a full color mode are performed in a monochrome mode.

By this control, it may be possible to realize printing that is satisfactory in terms of both of productivity and energy saving.

Control Example 3

If the mode switch 87 is switched from a full color mode position to a monochrome mode position while a full color mode printing job is ongoing, only the ongoing copy in the current full color mode printing job is printed in a full color mode and then the control unit 88 drives the stepping motor 40 so that a position of the rack 42 is changed to a power-off mode position (PO position). At this time, operations of all image producing units including the black image producing unit are temporarily suspended and a message is displayed, for example, on an a liquid crystal display portion of an operation panel (not shown) to allow a user to have a choice of whether to terminate the printing for the rest of the current printing job; whether to continue printing in a full color mode; or whether to continue printing in a monochrome mode.

By this control, a user can optionally select image quality, productivity, or power consumption.

Control Example 4

Figure 15:
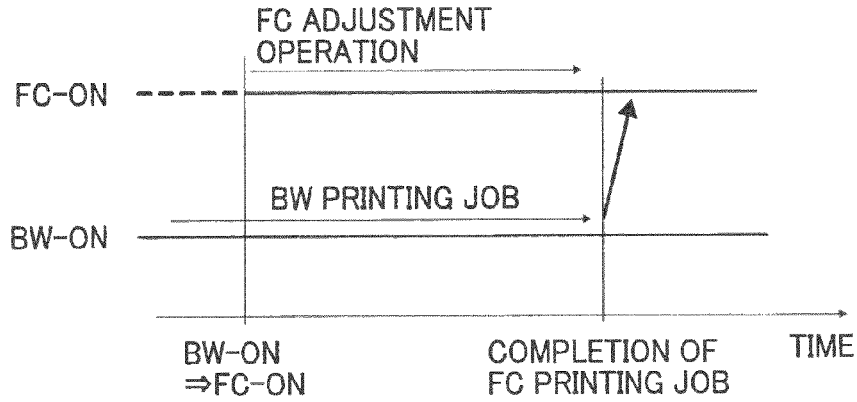
FIG. 15 is a timing chart of Control example 4 of the first embodiment (2)

If the mode switch 87 is switched from a monochrome mode position to a full color mode position while a monochrome mode printing job is ongoing, printing jobs originally scheduled to be performed in a monochrome mode are performed as scheduled without suspension of the monochrome mode printing operation as shown in FIG. 15. For this instance, in parallel with the monochrome mode printing operation, the color image producing units are turned on to start up so that adjustment operations (color deviation adjustment and density adjustment) are performed and thus the printing can be promptly performed under appropriate image forming conditions when it comes time to perform a full color mode printing job.

Since the monochrome image producing unit is provided independently of the color image producing units in the image forming apparatus according to this embodiment as described above, the image forming apparatus can perform the concurrent adjustment operations.

The adjustment operations of the color image producing units are performed by forming an image density measuring pattern such as a gradation pattern and a position information pattern such as a color deviation pattern on the intermediate transfer belt 7 with the use of color toners corresponding to Y, C, and M and detecting image forming positions and the amounts of adhered toners by the optical sensors 75 based on the light reflection.

The operation for adjusting color deviation of the color image producing units and the operation for adjusting density of the color image producing units will be described with reference to FIG. 16.

As described above, the optical sensors 75 are disposed, by means of a sensor holder 56, at three positions in the width direction, which is orthogonal to the moving direction of the intermediate transfer belt 7. Accordingly, the optical sensors can detect toner patterns Py, Pc, and Pm. The toner patterns Py, Pc, and Pm corresponding to the respective colors are formed on the intermediate transfer belt 7 so as to correspond to the positions of the optical sensors 75. Each of them has gradations in color tone (the color tone becomes thicker, for example, in the belt moving direction).

In an image adjustment mode of the color image producing unit, the followings are performed. That is, the amount of adhered toner is calculated based on the reflectance of the toner pattern; and image forming conditions are adjusted (process control) so that the amount of adhered toner in formed images becomes appropriate. Further, the color deviation amount is detected and the exposure positions of the respective colors are adjusted.

Figure 17:
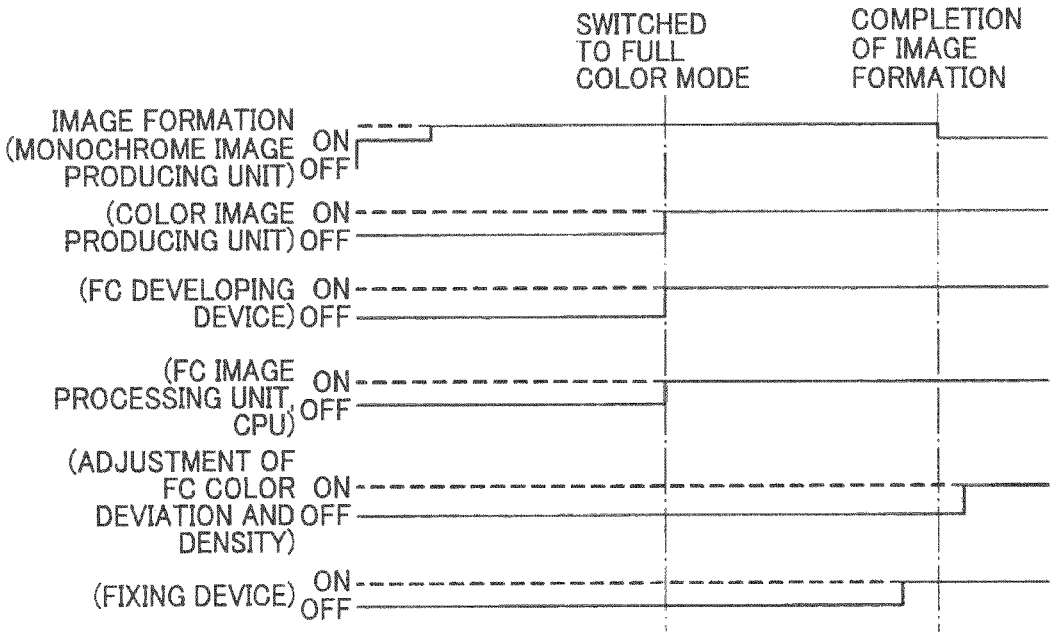
FIG. 17 is a timing chart, which corresponds to Control example 4, of a tandem type image forming apparatus where a color image producing unit and a monochrome image producing unit are juxtaposed with each other.

FIG. 17 shows timings used in a general tandem type image forming apparatus where a monochrome image producing unit and color image producing units are juxtaposed.

If the mode switch 87 is switched from a monochrome mode position to a full color mode position while a monochrome mode printing job is ongoing, the control unit 88 drives the stepping motor 40 so that the color image producing units are turned on in response to a switching signal and cause the respective Y, M, and C developing devices, an image processing section, a CPU, and the like to start up.

Further, after the monochrome mode printing job is finished, the color deviation adjustment or the density adjustment (process control) of each of the color image producing unit is performed. In this case, not only toner patterns Py, Pc, and Pm but also a black toner pattern Pk is formed at the same time.

Furthermore, the target fixing temperature (set fixing temperature) of the fixing device 9 is raised to the temperature suitable for a full color mode. A control for raising the target fixing temperature is performed just before the monochrome mode printing job is completed.

Since the adjustment operation of the color image producing units and the monochrome mode printing operation are concurrently performed, start-up of a full color mode printing operation that follows becomes faster, which results in improvement in productivity.

According to the above-described embodiments, there is provided as an example a structure in which the monochrome image producing unit is independent of the color image producing units and is disposed on the downstream side of the secondary transfer portion. However, the invention may be applied to a structure in which the monochrome image producing unit is disposed on the upstream side of the secondary transfer portion.

In addition, according to each of the above embodiments, there is provided, as an example, an image forming apparatus in which the monochrome image producing unit is independent of the color image producing units. However, the invention may also be applied to a tandem type image forming apparatus according to the related arts (which includes an intermediate transfer type image forming apparatus and a direct transfer type image forming apparatus) where a monochrome image producing unit is juxtaposed with color image producing units. According to the structure where the monochrome image producing unit is independent as described above, it may be possible to exclude the intermediate transfer belt 7 from power supply targets, to which power is supplied, by classifying the intermediate transfer belt 7 as "one of parts that are necessary to form an image in modes other than a monochrome mode." Therefore, energy saving is very effective.

Furthermore, although each of the above embodiments is described with an example in which the control method is applied to an electrophotographic image forming apparatus, which forms an electrostatic latent image on a photosensitive element, the control method may be also applied to an ink jet type image forming apparatus and the like.

Second Embodiment

Next, an image forming apparatus according to a second embodiment will be described.

Since the outlines of the structure and operation of an image forming apparatus according to this embodiment are the same as those of the first embodiment described with reference to FIGS. 18 to 20, the description thereof will not be repeated here.

Second Embodiment (1)

First, the structure and function of a mode switch 60 according to a second embodiment (1) will be described in detail.

As shown in FIG. 24, the mode switch 60 is a hard switch where a main power switch is formed integrally with a mode switching unit that performs switching selectively and manually between a monochrome mode and a full color mode. Meanwhile, the structure shown in FIG. 24 is a structure that lacks a lock release button as compared with the above-mentioned structure shown in FIG. 1.

Figure 24A:
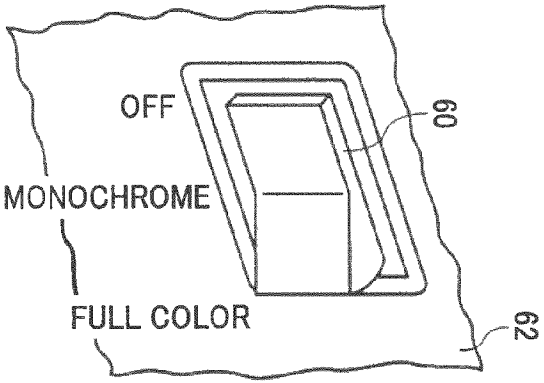
FIGS. 24A to 24C are perspective views of a mode switch.
Figure 24B:
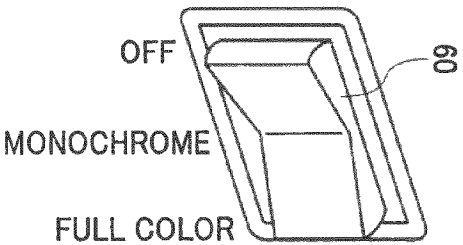
Figure 24C:
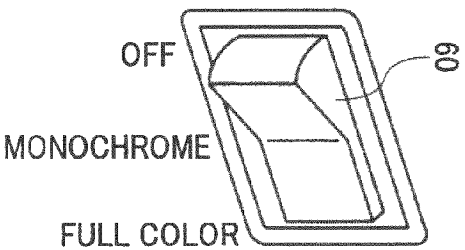

FIG. 24A shows a state where a left portion of the mode switch 60 is pushed in; and this state corresponds to a power-off mode position that is the same as the OFF state by a main power switch in the related art. FIG. 24B shows a monochrome mode position that is one of power-on mode positions. FIG. 24C shows a full color mode position that is also one of power-on mode positions.

FIG. 24A shows an apparatus-side plate 62 (which is not shown in FIGS. 24B and 24C).

Figure 25:
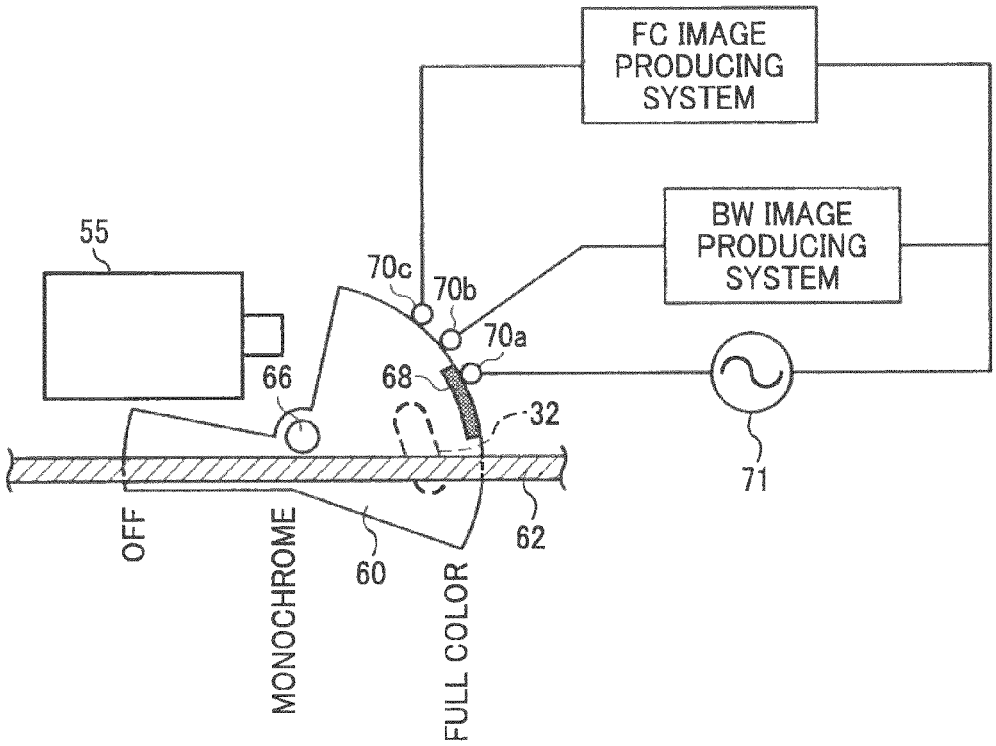
FIG. 25 is a schematic cross-sectional view showing a state where the mode switch is set to a power-off mode position.

As shown in FIG. 25, the mode switch 60 is supported, on the apparatus-side plate 62, by a shaft 66 and a bracket (not shown) in a swiveling manner and is positioned at each of the set positions by snap-fitting.

A portion of the mode switch that is disposed on the full color mode position side has the shape of a fan and is thick. The peripheral surface of the portion of the mode switch is provided with a conductive section 68. Connecting terminals 70*a*, 70*b*, and 70*c* are provided in the main body of the image forming apparatus so as to face the conductive section 68. The conductive portion 68 is long enough to electrically connect the connecting terminal 70*a* and the connecting terminal 70*c*.

When the connecting terminals 70*a* and 70*b* are electrically connected to each other, power is supplied only to the monochrome image producing unit (a BW image producing system) that is necessary to produce an image in a monochrome mode, but is not supplied to parts that are necessary to produce an image in modes other than the monochrome mode. In other words, the color image producing units and the intermediate transfer belt 7 are not supplied with power. A power supply unit 71 is also provided.

Further, when the mode switch is set to a monochrome mode, the linear speed of a sheet is set to be higher than that in a full color mode; and a target fixing temperature is set to be lower than that in a full color mode.

When the connecting terminals 70*a* and 70*c* are electrically connected to each other, power is supplied to the full color image producing unit (a BW image producing system+a FC image producing system). Here, the "FC image producing system" includes the Y, M, and C color image producing units but excludes the black image forming unit.

FIG. 25 shows a state where the mode switch 60 is set to a power-off mode position. This state corresponds to a power-off state of a main power switch in the related art.

Figure 26:
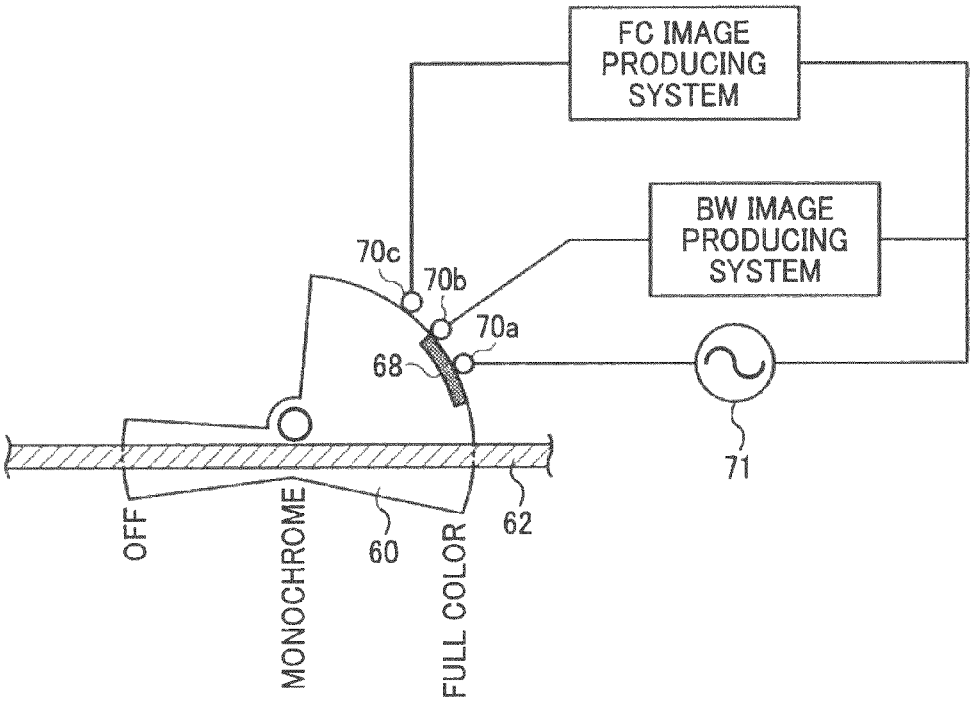
FIG. 26 is a schematic cross-sectional view showing a state where the mode switch is set to a monochrome mode position.

When the mode switch 60 is set (switched) to a monochrome mode position, the connecting terminals 70*a* and 70*b* are electrically connected to each other by the conductive section 68 as shown in FIG. 26. Therefore, power is supplied only to the monochrome image producing unit (the BW image producing system) that is necessary for printing in a monochrome mode but is not supplied to parts that are necessary to form an image in modes other than a monochrome mode. Accordingly, it may be possible to regulate the power, which is supplied to the monochrome image producing unit and the color image producing units, by the mode switch 60.

The description will be given in detail on the basis of the structure of the image forming apparatus. Given the case in which the mode switch 60 is set to a monochrome mode, the supply of power for driving the three, that is, Y, M, and C image producing units, the intermediate transfer belt 7, and the like is interrupted. The adjustment of the positional deviation among respective colors, the adjustment of the density of images except for a black image, and the like are not performed in a monochrome mode. Accordingly, it may be possible to reduce power consumption incurred by unnecessary operations and to reduce consumption of toners except for a black toner.

Figure 27:
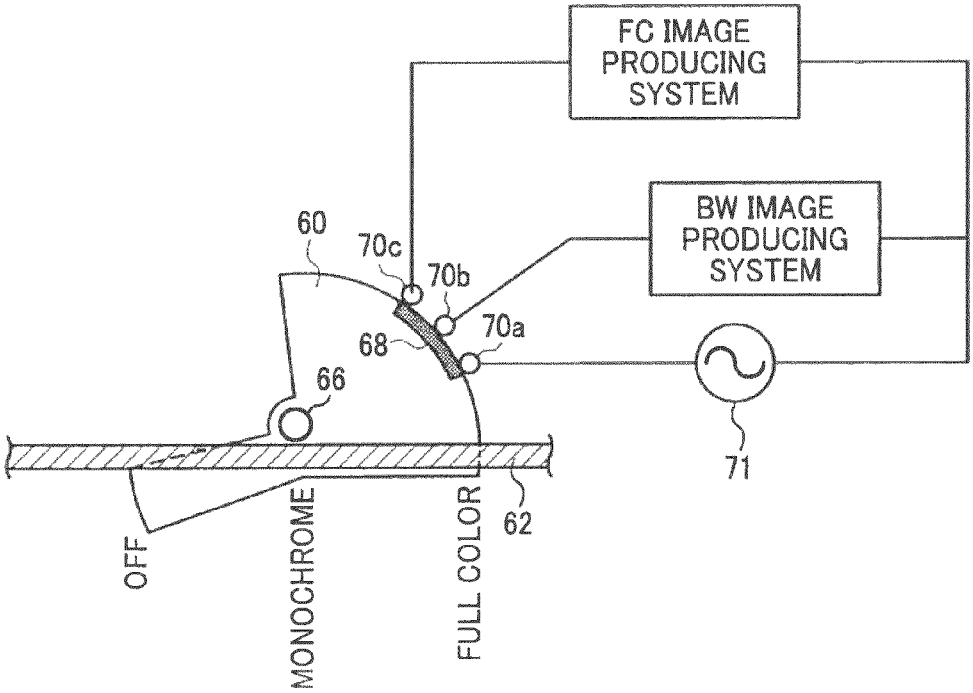
FIG. 27 is a schematic cross-sectional view showing a state where the mode switch is set to a full color mode position.

When the mode switch 60 is set to a full color mode position, as shown in FIG. 27, power is supplied to the BW image producing system and the FC image producing system like in an ON state of the main power switch in the related art.

The adjustment of the positional deviation among respective colors, the adjustment of the density of images (process control), and the like are regularly performed in a full color mode like in the image forming apparatus in the related art.

Meanwhile, as shown in the FIG. 7, a power-off mode position may be disposed between a monochrome mode position and a full color mode position. For this instance, when the mode switch is switched from a monochrome mode to a full color mode or when the mode switch is switched from a full color mode to a monochrome mode, the mode switch is switched by way of the power-off mode position.

With such structure, the mode switch needs to be manipulated in an opposite direction for switching to a monochrome mode and for switching to a full color mode when the power-off mode ends and power supply is initiated. Accordingly, the mode switch can be adapted in a manner such that a monochrome mode and a full color mode are intentionally selected.

A toggle type mode switch may be used as the mode switch as shown in the above-mentioned FIGS. 9 to 11.

Figure 21:
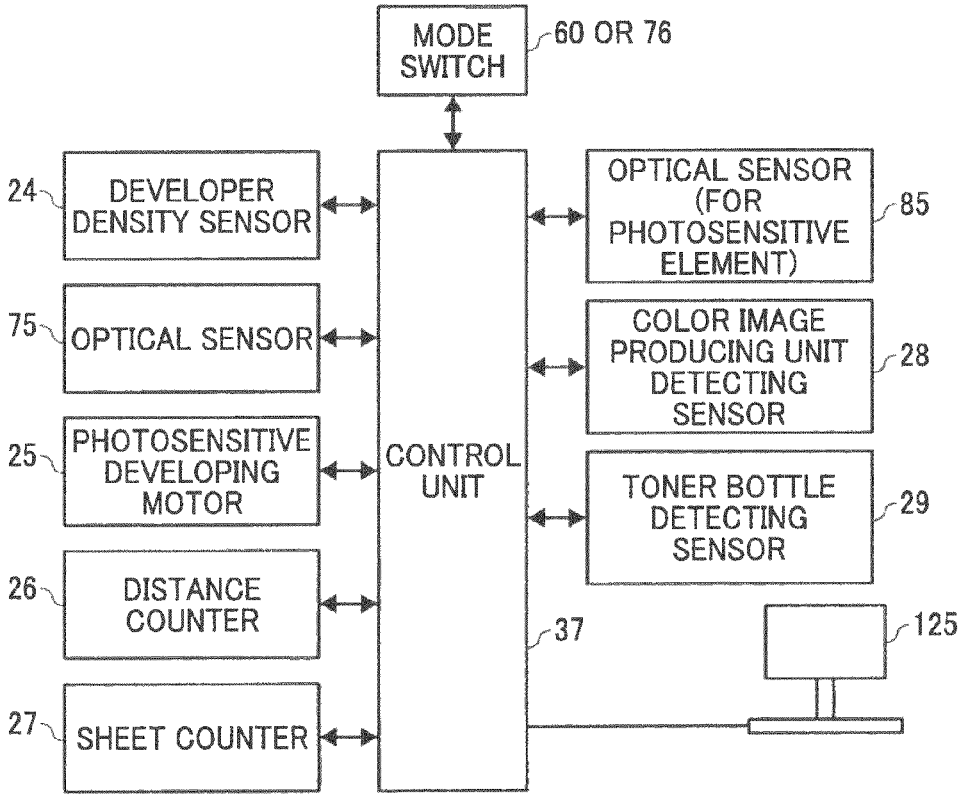
FIG. 21 is a control block diagram of an image forming apparatus according to a second embodiment.

FIG. 21 shows a control block diagram of this embodiment.

The control unit 37 of the image forming apparatus 100 is a microcomputer that includes a CPU, an I/O interface, a ROM, a RAM, and the like. The control unit 37 can grasp which position the mode switch 60 or 76 is set to, by a position sensor or a connection circuit (not shown).

A personal computer (hereinafter, simply referred to as a "PC") 125 is connected to the image forming apparatus 100 in a communicable manner via the control unit 37 by a wired system (LAN or the like) or a wireless system (wireless LAN, Bluetooth, IrDA, or the like).

A full color failure detecting unit will be described below. The full color failure detecting unit is a unit for detecting failures of image forming devices other than a black image forming device and detecting abnormal operations of the devices. As the detecting unit, used are developer density sensors 24 that detect the densities of developers in the developing devices; optical sensors 75 as sensors that are disposed so as to face the intermediate transfer belt 7 to detect the amounts of adhered toners; optical sensors 85 as sensors that detect the amounts of toners adhered to the photosensitive elements 1; and the operation signals for developing motors 25 and the photosensitive elements.

Predetermined values, which are used together with the detected values of these sensors or the operation signals, to determine failures are previously stored in the ROM of the control unit 37.

If any one of the respective detected values exceeds a predetermined value, the control unit 37 determines such that the color image producing units are out of order.

The developer density sensors 24, the optical sensors 75, and the optical sensors 27 output detection results at predetermined timings; and a density adjustment operation is performed based on the output values. Examples of timings for detection include a timing when a power supply unit is turned on, a timing when each sheet passes, a timing when a print signal is input or output, a timing when a density gets high, and a timing when a density gets low. In the case in which a normal operation is not achieved even though adjustment is performed several times (which vary according to conditions), abnormality is displayed.

When abnormality is detected, the fact that abnormality is detected is notified to a user through a message display unit as described below. An operation panel of the main body of the image forming apparatus, dialogue display on the screen of the PC 125, or the like may be used as the message display unit.

A full color life detecting unit will be described below. A full color life detecting unit is a unit for detecting the operating lives of color image producing devices (the photosensitive elements, the developing devices, the developers, and the like) other than black image producing devices. It detects the lives of the devices. As the detecting unit, used is a distance counter 26 that measures an operation distance based on the drive time of the photosensitive element developing motor 25, a sheet counter 27 that counts the number of output sheets, and the like.

A predetermined life distance and a threshold value in number of sheets are stored in the ROM of the control unit 37.

In the case in which these counter values exceed the predetermined value or the threshold value when these counter values are compared with the predetermined life distance and the threshold value in number of sheets, the control unit 37 determines such that the lives of the color image producing units come to an end.

Meanwhile, when the lives are detected, the fact that the lives are detected is notified to a user through the message display unit. Examples of the message display unit include an operation panel of the main body of the image forming apparatus, a dialogue display on the screen of the PC 125, or the like.

Further, detection signals are sent to the control unit 37 from the color image producing unit detecting sensors 28 that detect whether the color image producing units are mounted or not and toner bottle detecting sensors 29 that detect whether the toner bottles are mounted or not.

Figure 22:
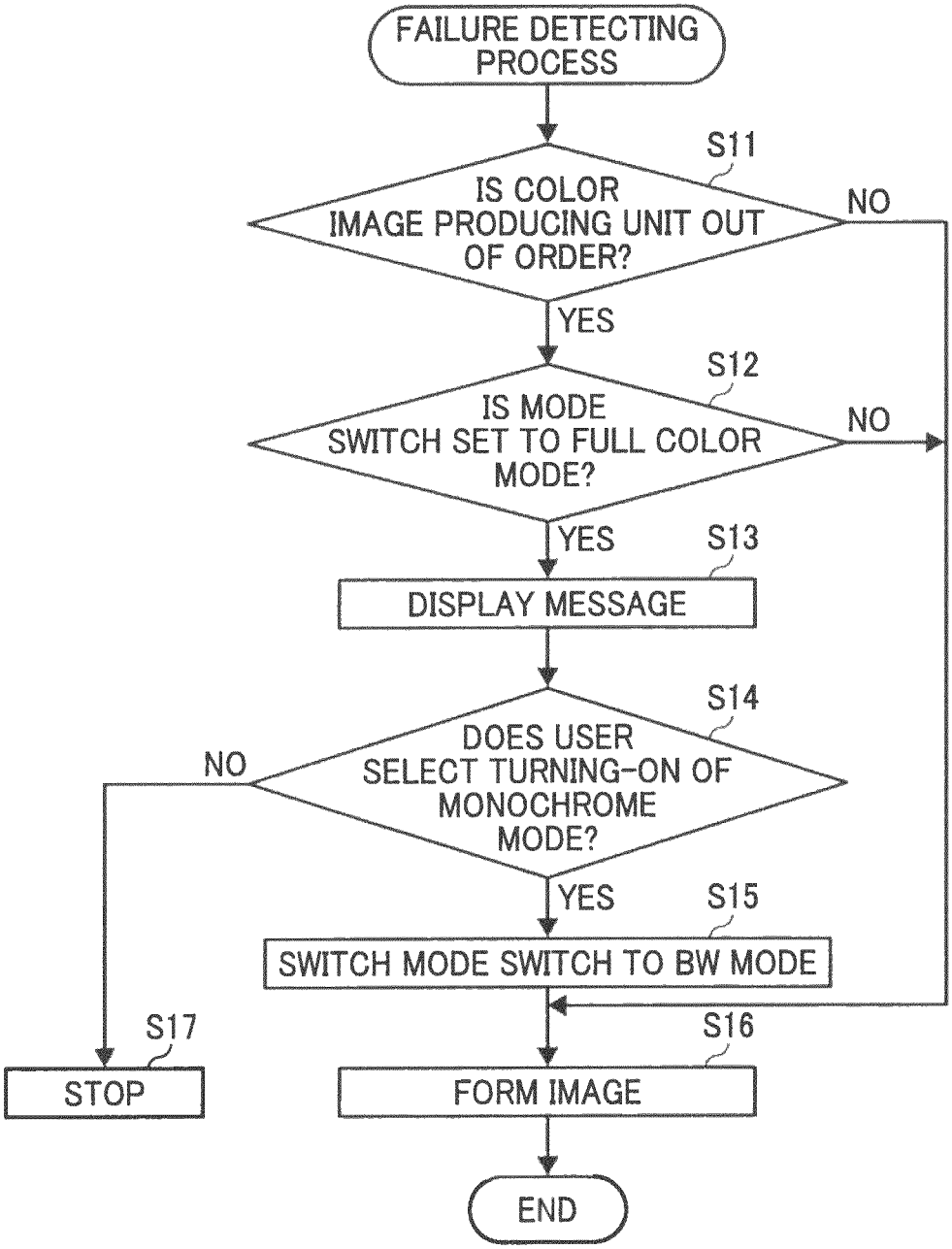
FIG. 22 is a flowchart illustrating a control operation for failure detection.

A full color failure detecting operation will be described with reference to a flowchart shown in FIG. 22.

When processing is started, first, the control unit 37 compares the detected values (which are outputs from the developer density sensors 24, the optical sensors 75, and optical sensors 85 of the Y, M, and C color image producing units) or the operation signals output from the photosensitive elements or the developing motors 25 with the predetermined value (threshold value) stored in the ROM; and determines whether the color image producing units are out of order or not (Step S11).

If it is determined such that any one of the color image producing units is out of order, it is further checked whether the mode switch 60 or 76 is set to a full color mode or not (Step S12). Here, if the mode switch is set to the full color mode, the control unit displays a message, for example, "The color image producing unit is out of order. Please switch the mode switch to a monochrome mode." through the message display unit and prompts a user to switch the mode switches (Step S13).

After that, it is checked whether the user has switched the mode switch to a monochrome mode or not (Step S14). If the user has switched the mode switch to a monochrome mode, the mode switch is set to a monochrome mode (Step S15) and the image formation is performed (Step S16). Meanwhile, if the user has not switched the mode switch to a monochrome mode in Step S14, the image formation operation is terminated (Step S17).

According to this, the image formation mode can be selected according to user's needs and thus productivity improves and image quality is maintained.

The full color failure detection may be performed on the basis of the detected value of one detecting unit among the plurality of detecting units. Alternatively, the full color failure detection may be performed on the basis of the detected values of the plurality of detecting units.

Figure 23:
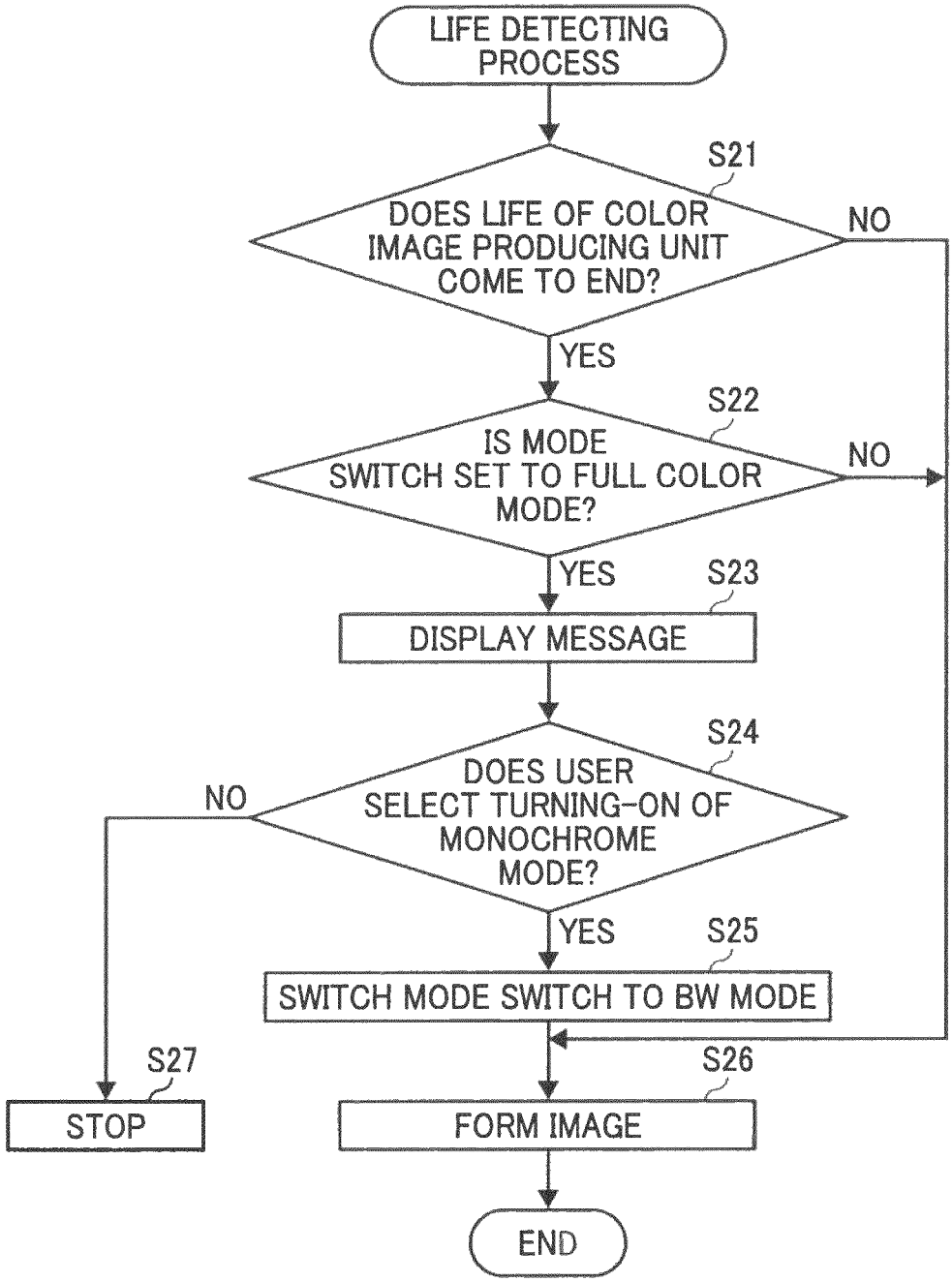
FIG. 23 is a flowchart illustrating a control operation for life detection.

A full color life detecting operation will be described with reference to a flowchart shown in FIG. 23.

First, the control unit 37 calculates the operation distance of the photosensitive element developing motor 25 of the color image producing unit on the basis of the counter value (time) of the distance counter 26; updates a statistical distance by adding the operation distance to a statistical operation distance of the past; and compares the statistical distance with a predetermined life distance (Step S21).

Alternatively, the control unit compares the threshold value in number of sheets with the counter value (the number of sheets) of the sheet counter 27 in the color image producing unit.

Subsequently, if it is determined that the life of any one of the color image producing units came to an end, it is checked whether the mode switch 60 or 76 is set to a full color mode or not (Step S22). If the mode switch is set to a full color mode, the control unit displays a message, for example, "The life of the color image producing unit came to an end. Please switch the mode switch to a monochrome mode." by the message display unit and prompts a user to switch the mode switches (Step S23).

After that, it is checked whether the user has switched the mode switch to a monochrome mode or not (Step S24). If the user has switched the mode switch to a monochrome mode, the mode switch is set to a monochrome mode (Step S25); and formation of an image is performed (Step S26). Meanwhile, if the user has not switched the mode switch to a monochrome mode in Step S24, the image forming operation is terminated (Step S27).

According to this, the image formation mode can be selected according to user's needs and thus the productivity improves the image quality is maintained.

The full color life detection may be performed on the basis of the detected value of one detecting unit among the plurality of detecting units. Alternatively, the full color life detection may be performed on the basis of the detected values of the plurality of detecting units.

Second Embodiment (2)

Next, a second embodiment (2) will be described.

In the second embodiment (1), the mode switch itself directly has a function as an electrical contact. However, as shown in the above-mentioned FIG. 12, according to the structure of this embodiment, the switching position of a mode switch is detected; and switching among modes is achieved by a mode switching mechanism.

Figure 28:
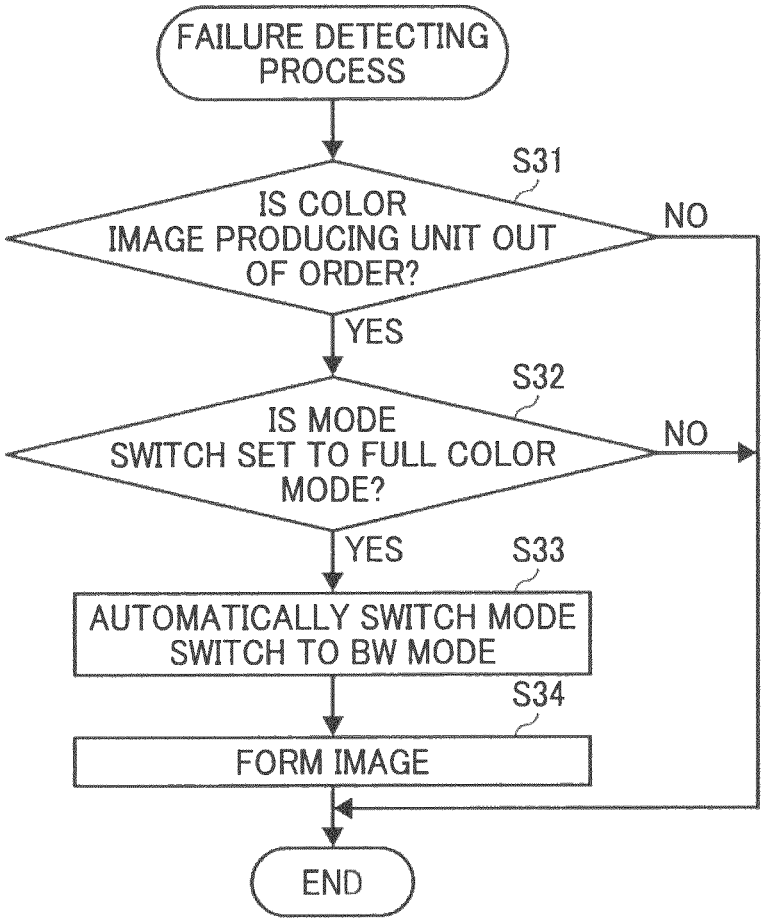
FIG. 28 is a flowchart illustrating a control operation for failure detection of a second embodiment (1)

A full color failure detecting operation of this embodiment will be described with reference to a flowchart shown in FIG. 28 and the structure of FIG. 12.

When the full color failure detecting operation is started, first, it is determined whether the color image producing unit is out of order or not (Step S31). Here, when it is determined that the color image producing unit is out of order, it is further checked whether the mode switch 87 is set to a full color mode or not (Step S32). Here, when it is determined that the mode switch is set to a full color mode, the control unit 37 automatically switches the mode switch 87 to a monochrome mode by driving the stepping motor 40 (Step S33) and performs the formation of an image in a monochrome mode (Step S34).

Although not shown, the control unit may display a message, for example, "The color image producing unit is out of order; and printing is currently available only in a monochrome mode." through the message display unit after the mode switch is switched to a monochrome mode.

Since the mode switch is automatically switched, it may be possible to remove downtime due to a failure of parts, which results in an improvement in productivity.

Figure 29:
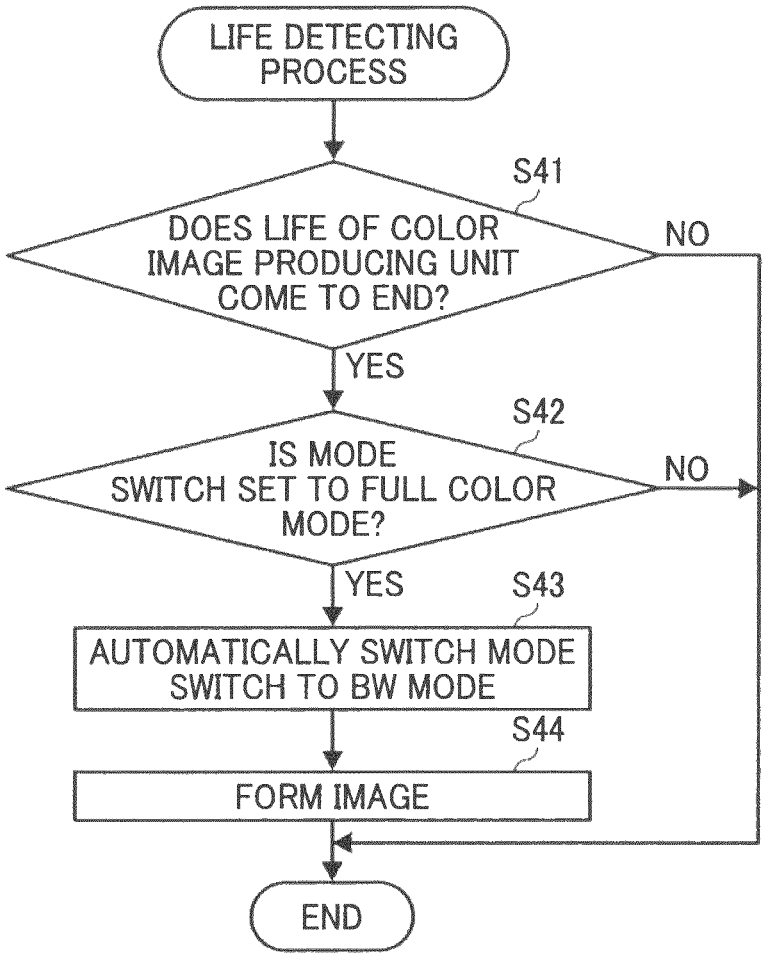
FIG. 29 is a flowchart illustrating a control operation for life detection of a second embodiment (2)

The full color life detecting operation is illustrated in a flowchart of FIG. 29.

When the full color life detecting operation is started, first, it is determined whether the life of the color image producing unit came to an end or not (Step S41). Here, when it is determined that the life of the color image producing unit came to an end, it is further checked whether the mode switch 87 is set to a full color mode or not (Step S42). Here, when it is determined that the mode switch is set to a full color mode, the control unit 37 automatically switches the mode switch 87 to a monochrome mode by driving the stepping motor 40 (Step S43) and performs the image formation in a monochrome mode (Step S44).

Although not shown, the control unit may display a message, for example, "The working life of the color image producing unit expires; and printing is available currently only in a monochrome mode." through the message display unit after the mode switch is switched to a monochrome mode.

Since the mode switch is automatically switched, it may be possible to remove downtime due to the expiration of the working life, which results in an improvement in productivity.

Second Embodiment (3)

Figure 30:
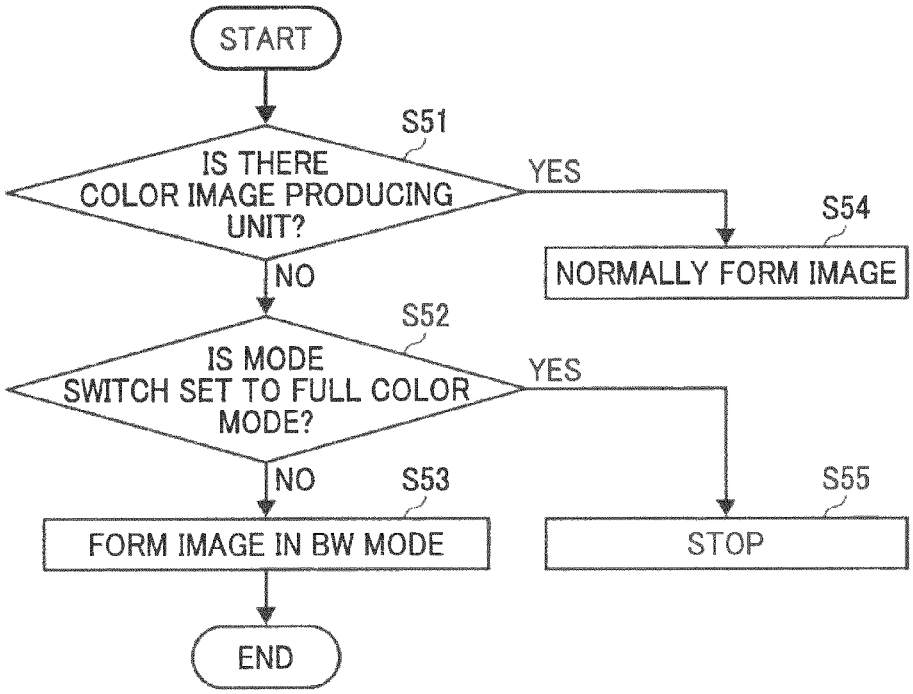
FIG. 30 is a flowchart illustrating a control operation of a second embodiment (3)

After that, a second embodiment (3) will be described with reference to a flowchart shown in FIG. 30.

When the control unit 37 starts this operation, first, the control unit checks whether the color image producing units are mounted on the basis of signals sent from the color image producing unit detecting sensors 28 (Step S51). Here, if the color image producing units are mounted, the usual image formation, which can be performed usually in any one of a monochrome mode and a full color mode, is performed (Step S54).

The color image producing unit detecting sensors 28 are provided for Y, M, and C, respectively. Accordingly, if any color image producing unit is not mounted, it is determined such that the color image producing units are not mounted.

Meanwhile, when the color image producing units are not mounted in Step S51, it is further checked whether the mode switch 87 is set to a full color mode (Step S52). Here, if the mode switch 87 is set to a full color mode, the image forming operation is stopped and the message "The color image producing unit is not mounted" is displayed (Step S55).

If the mode switch 87 is set to a monochrome mode in Step S52, the image formation in a monochrome mode is performed (Step S53).

By this control operation, the printing in a monochrome mode can be performed even when the color image producing units are not mounted due to maintenance or the like, and it may be possible to reduce downtime caused by holding-on until maintenance or replacement of parts of the color image producing units is finished, which results in an improvement in productivity.

Second Embodiment (4)

Figure 31:
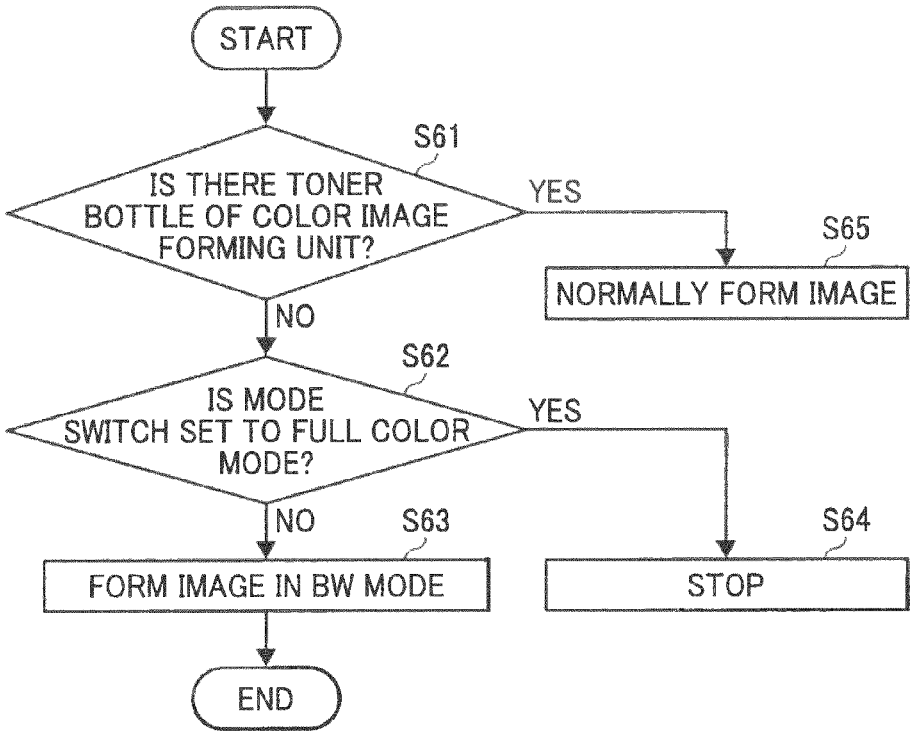
FIG. 31 is a flowchart illustrating a control operation of a second embodiment (4)

Next, a second embodiment (4) will be described with reference to a flowchart shown in FIG. 31.

When the control unit 37 starts this operation, first, the control unit checks whether color toner bottles are set on the basis of signals sent from the toner bottle detecting sensors 29 (Step S61). Here, if all of the Y, M, and C color toner bottles are set, the usual image formation, which can be performed usually in any one of a monochrome mode and a full color mode, is performed (Step S65).

If any one of the Y, M, and C color toner bottles is not set, it is determined that the color toner bottles are not set.

Meanwhile, when it is determined that the color toner bottles are not set in Step S61, it is further checked whether the mode switch 87 is set to a full color mode (Step S62). Here, when it is determined that the mode switch 87 is set to a full color mode, the image forming operation is stopped and the message "The color toner bottles are not set" is displayed (Step S64).

If the mode switch 87 is set to a monochrome mode in Step S62, the image formation in a monochrome mode is performed (Step S63).

By this control operation, the printing in a monochrome mode can be performed even when the color toner bottles are not set. Accordingly, it may be possible to reduce downtime caused by holding on until replacement of the color toner bottles is finished, which results in an improvement in productivity.

Since the monochrome image producing unit is provided independently of the color image producing units in the image forming apparatus according to this embodiment as described above, the image forming apparatus can perform the adjustment operations of the color image producing units during the printing in a monochrome mode.

The adjustment operations of the color image producing units are performed by forming an image density measuring pattern such as a gradation pattern and a position information pattern such as a color deviation pattern on the intermediate transfer belt 7 with the use of color toners corresponding to Y, C, and M and detecting image forming positions and the amounts of adhered toners through the reflection in the optical sensors 75.

Figure 16:
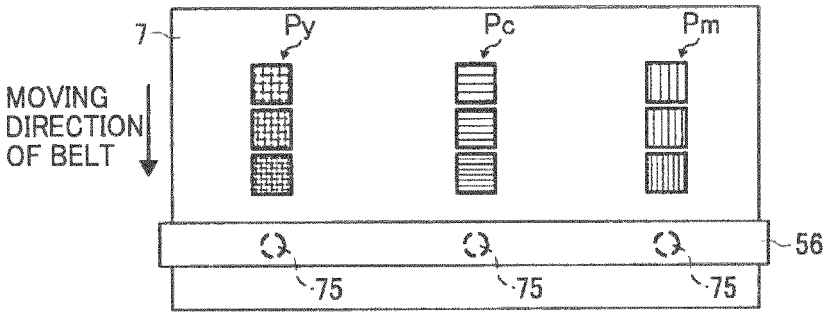
FIG. 16 is a schematic plan view showing the mechanism of density adjustment and color deviation correction of a color image producing unit.

Meanwhile, the density adjustment operation and the color deviation adjustment operation of the color image producing units are performed in the same manner as that shown in the above-mentioned FIG. 16. Therefore, the description thereof will not be repeated here.

Each embodiment of the above is explained with an exemplary structure in which the monochrome image producing unit independent of the color image producing units is disposed on the downstream side of the secondary transfer portion. However, the invention may be applied to a structure where the monochrome image producing unit is disposed on the upstream side of the secondary transfer portion.

Further, although each embodiment of the above is explained with an exemplary image forming apparatus where the monochrome image producing unit is independent of the color image producing units, the invention may be applied to a tandem type image forming apparatus according to the related arts (which includes an intermediate transfer type image forming apparatus and a direct transfer type image forming apparatus) where a monochrome image producing unit is juxtaposed with color image producing units. According to the structure where the monochrome image producing unit is independent as described above, it may be possible to exclude the intermediate transfer belt 7 from power supply targets, to which power is supplied, by classifying it as "one of parts that are necessary to form an image in modes other than a monochrome mode,". Therefore, energy saving is very effective.

Furthermore, although each of the above embodiments is explained with an example in which the control method is applied to an electrophotographic image forming apparatus, which forms an electrostatic latent image on a photosensitive element, the invention may be applied to an ink jet type image forming apparatus and the like.

The characteristics and the like of the above-mentioned second embodiment will be collectively described below.

First, the image forming apparatus has a monochrome mode and a full color mode as image forming modes; and a power supply unit of the apparatus is turned on and off by a main power switch. The main power switch and a mode switching unit for selecting one mode from a monochrome mode and a full color mode in manual are integrally formed as one mode switch. The image forming apparatus has a structure in which power is not supplied to the parts that are necessary to form an image in modes other than a monochrome mode when the mode switch is set to a monochrome mode. Further, the image forming apparatus includes the full color failure detecting unit for detecting failures of the color image producing units that operate in a full color mode.

Second, in the image forming apparatus having the first characteristic, the mode switch can be set to any one of a power-off mode position where the power supply unit of the image forming apparatus is turned off, a monochrome mode position that is one of power-on positions, and a full color mode position that is also one of power-on positions.

Third, in the image forming apparatus, a message for prompting a user to change the mode to a monochrome mode is displayed if a failure of the color image producing unit occurs while the apparatus operates in a full color mode.

Fourth, in the image forming apparatus, the full color failure detecting unit determines whether a failure occurred or not, on the basis of at least one or more signals out of signals including a signal output from a developer density detecting sensor that detects the density of a developer, a signal output from a sensor that detects the amount of adhered toner, a control signal of a motor that rotationally drives the image carrier, and a control signal of a developing motor.

Fifth, the image forming apparatus includes a power supply unit; a mode switching mechanism that turns on and off a monochrome mode and a full color mode; and a control unit that detects the changed position of the mode switch so as to control the mode switching mechanism.

Sixth, in the image forming apparatus, the mode switch is automatically switched to a monochrome mode if a failure of the color image producing unit occurs while the apparatus operates in a full color mode.

Seventh, the image forming apparatus includes a full color life detecting unit for detecting the lives of the color image producing units, and displays a message for prompting a user to change the mode to a monochrome mode, when the printing in a full color mode is not available due to the expiration of the life of any one of the color image producing units.

Eighth, the image forming apparatus includes the full color life detecting unit for detecting the lives of the color image producing units, and automatically switches the mode switch to a monochrome mode when the printing in a full color mode is not available due to the expiration of the life of any of the color image producing units.

Ninth, in the image forming apparatus, the full color life detecting unit is a counter that measures the number of sheets on which images are printed or measures the time how long the image production is performed by the image forming apparatus.

Tenth, in the image forming apparatus, the printing in a monochrome mode can be performed even though the color image producing units are not mounted partially when a monochrome mode is turned on.

Eleventh, in the image forming apparatus, when a monochrome mode is turned on, the printing in a monochrome mode can be performed even though color toner bottles for supplying toners to the color image producing units are not mounted.

Twelfth, the image forming apparatus includes a plurality of image carriers that correspond to respective colors including black, respectively; a plurality of developing devices that receive developers for developing latent images formed on the respective image carriers and are provided so as to correspond to the respective image carriers; and an intermediate transfer body to which developed toner images are transferred. The image carriers and the developing devices for the colors other than black are disposed so as to transfer the developed toner images to the intermediate transfer body. The image carrier and the developing device, which correspond to black, are disposed independently of the intermediate transfer body. The image forming apparatus includes a transfer-conveying unit for conveying a recording medium in the state of being in contact with the intermediate transfer body and the image carrier corresponding to black. The toner image, which is formed on the image carrier corresponding to black, can be directly transferred onto the recording medium. The toner image, which is formed on the image carrier corresponding to black, and the toner images, which are formed on the intermediate transfer body, can be superimposed and transferred onto the recording medium. The intermediate transfer body belongs to parts that are necessary to form an image in modes other than a monochrome mode.

Thirteenth, the image forming apparatus includes sensors that detect the adhesion states of the toner images formed on the intermediate transfer body. If the mode switch is switched from a monochrome mode position to a full color mode position while a monochrome mode printing job is ongoing, the adjustment operations of the color image producing units are performed while the monochrome mode printing job is being performed after the switch is switched. The adjustment operations include forming color toner images on the intermediate transfer body, and feeding back the detection results of the sensors to the image forming conditions.

Accordingly, since the image forming apparatus has the above-mentioned characteristics, it may be possible to usually cope with monochrome documents, which are most of output documents, and to make color outputs when color outputs are necessarily needed. Therefore, it may be possible to provide an image forming apparatus that may not perform unnecessary correction of positional deviation and adjustment of density for each color, suppress the generation of adjustment time and unnecessary toner consumption, prevent the degradation of units, and efficiently form a color image.

Further, it may be possible to reduce downtime due to failures, the expiration of lives of parts, or the event that the color image producing units or the toner bottles are not mounted.

Third Embodiment

Next, an image forming apparatus according to a third embodiment will be described.

Since the outlines of the structure and operation of the image forming apparatus according to this embodiment are the same as those of the first embodiment described with reference to FIGS. 18 to 20, the description thereof will not be repeated here.

The structure and function of a mode switch 60 according to a third embodiment are the same as those described with reference to FIGS. 24 to 27 and FIGS. 8 to 12, the description thereof will not be repeated here.

Figure 32:
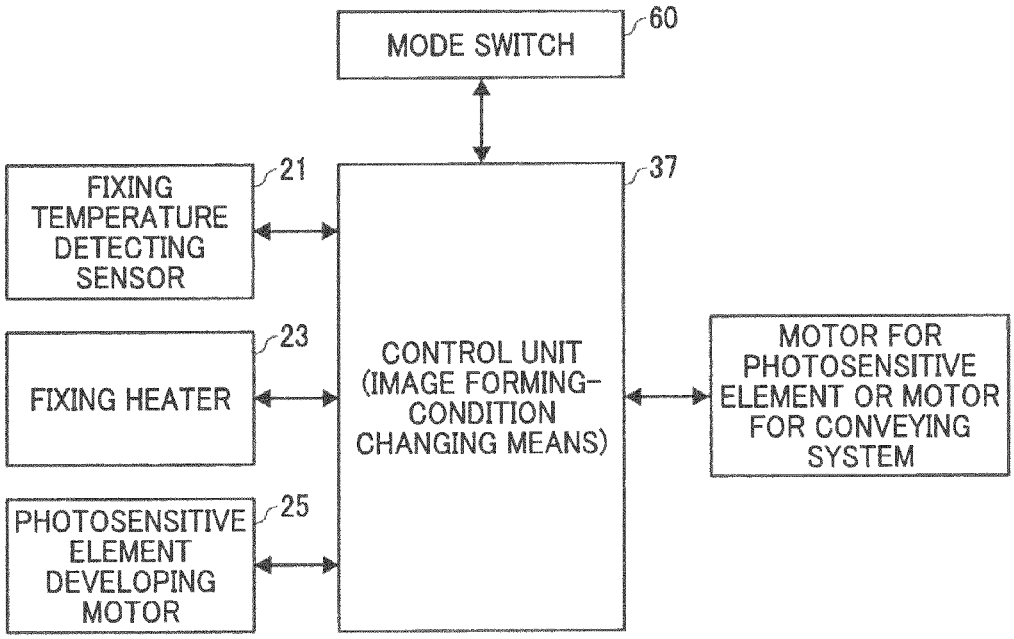
FIG. 32 is a control block diagram of an image forming apparatus according to a third embodiment.

FIG. 32 shows a block diagram of a control system of the third embodiment.

A control unit 37 of the image forming apparatus is a microcomputer that includes a CPU, an I/O interface, a ROM, a RAM, and the like. The control unit 37 can find out which position the mode switch 60 is set to, with the use of a position sensor or a connection circuit (not shown). A mode switch 76 or 88 may be used instead of the mode switch 60.

A detection signal from a fixing temperature detecting sensor 21, which detects the temperature of a fixing belt (fixing roller) of a fixing device 30, is input to the control unit 37. The control unit 37 controls the amount of power, which is supplied to the fixing heater 23, on the basis of the detection signal output from the fixing temperature detecting sensor 21.

The control unit 37 also functions as an image forming condition changing unit.

When a monochrome mode is set by the mode switch 60, the color deviation adjustment does not need to be performed. The reason for this will be described below.

Since four color images need to be superimposed to form a color image, it is natural to perform color deviation adjustment. In general image forming apparatuses, it is difficult to grasp the time to form a color image. Accordingly, even while an image forming operation only for black (monochrome) images Bk is performed, the adjustment operation needs to be performed at a predetermined timing (usually, at an interval of a predetermined number of sheets or at an interval of a predetermined time).

For this reason, even while only black images Bk are formed, a color matching operation needs to be performed in the middle of the formation of an image with an interruption or after completion of the formation of an image. The color matching operation incurs waiting time. It also incurs consumption of color toners and inevitably needs to drive the color image producing units.

In this embodiment, since the printing output is limited to the forming of black images Bk when a monochrome mode is set by the mode switch 60, the color matching operation does not need to be performed.

Next, the reason why the amount of the adhered black toner can be reduced in a monochrome mode will be described.

When a color image is formed, some amount of adhered black toner (image density) that is necessary for reproduction of a color image is needed.

In this embodiment, since the printing output is limited to the forming of black images when a monochrome mode is set by the mode switch 60, it may be possible to reduce the amount of adhered black toner (image density). The reduction in amount of adhered black toner is preferable for the control of the usual amount of adhered toner. The reduction in amount of adhered toner leads to the reduction in toner consumption.

The image density of black toner, when a color image is formed, is generally in the range of about 1.4 to 1.6. The image density of black toner, when a black image is formed, is generally about 1.2. Accordingly, when a user selects a monochrome mode, it is most preferable that the image density be about 1.2, considering that photographic image quality is demanded even on the black image. In actual, a target value of the black image density of the image forming apparatus is about 1.2.

It may be possible to reduce toner consumption when the above-mentioned specifications are satisfied when a monochrome mode (BW) is turned on. Further, it may be possible to shorten waiting time and to improve productivity by lengthening an interval of the color deviation adjustment or an interval of the process control in a monochrome mode.

The reason why an interval of the control for adjustment of the amount of adhered toner can be increased:

Image quality, which is required for only black images, is different from image quality that is required for color images. Naturally, since black images are mostly letters or line images, high image quality required for photographic images or the like is not required for the black images.

An interval of color matching/image density adjustment:

In a general color image forming apparatus, control may be performed under the following conditions.

a power supply unit is turned on.

Control is performed due to a concern that the amount of electrostatic charge of toner decreases while it is left intact.

Per a predetermined number of sheets on which images are formed (about per 100 sheets in the color image forming apparatus although there is a variation).

Control is performed after image production is finished.

Control is performed, suspending and interrupting the image production.

Control is performed when there is a concern that the amount of electrostatic charge of toner changes, the internal temperature of the apparatus rises, and the like, due to the performance of printing.

Control is performed due to a change in temperature of the outside air.

Adjustment is performed when there is a concern that the density changes due to a change in amount of electrostatic charge of toner and optical units are deformed due to a change in temperature and humidity.

The above-mentioned control is performed in the color image forming apparatus. However, if the mode switch 60 guarantees that a mode is limited to a monochrome mode, the control for correcting color deviation is not necessary and thus an interval of density adjustment can be lengthened.

Control Example 1

Figure 33:
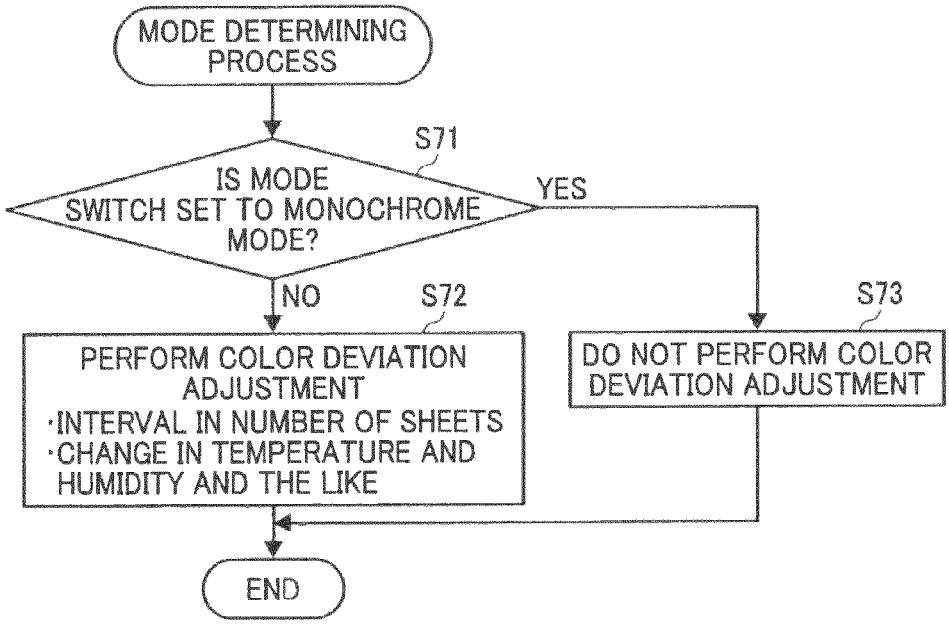
FIG. 33 is a flowchart illustrating an operation of Control example 1 according to the third embodiment.

Control example 1 of this embodiment will be described with reference to a flowchart shown in FIG. 33.

In order to determine a mode, first, it is determined which mode the mode switch 60 is set to when a power supply unit is turned on (Step S71). In this case, if a monochrome mode is selected, color deviation adjustment is not performed (Step S73). Meanwhile, if a full color mode is selected, a color image forming process, which includes color deviation adjustment and the like that are generally performed to form a color image, is performed (Step S72).

As described above, the color image producing units and the intermediate transfer belt 14 are controlled not to come into contact with each other in a monochrome mode. Accordingly, motors for driving the color image producing units and the like do not need to be driven and power such as a bias may not be supplied to the motors.

Since the use state of a color image forming apparatus is limited to a monochrome mode by the mode switch 60, power can be controlled and energy saving is effective.

Further, the color image producing units, which do not involve in formation of a monochrome image, do not need to operate. Accordingly, the color image producing units may not be unnecessarily used, which allows a color image forming device to be used for a relatively long time. This is advantageous in terms of costs from the user's viewpoint.

Here, potential control will be briefly described.

In the potential control, a plurality of toner adhesion patterns are transferred to the intermediate transfer belt 14 and these toner adhesion patterns are detected by optical sensors 50 for every color (to be described below) while a change is made in terms of light emitting power of a semiconductor laser of a writing device 6, charging bias voltages applied from charging units 4, and developing bias voltages applied to developing rollers 10 that correspond to the respective colors and are provided in the developing devices 8.

The control unit 37 obtains a developing input/output property from output signals that are detected by the optical sensors 50; calculates a charging bias voltage and a developing bias voltage by which the developing input/output property is adjusted to a target value; and uses these as image forming conditions at the time of the formation of an image.

The color matching adjustment will be briefly described. In a method of detecting positional deviation of the respective color images, positional deviation adjusting marks corresponding to the respective colors are formed by the respective image forming sections and the marks corresponding to the respective colors are transferred to the intermediate transfer belt 14, so that positional deviation detecting patterns are formed.

The positional deviation detecting patterns are detected by the optical sensors 50; the deviation among the photosensitive elements corresponding to the respective colors is calculated from the detection results based on the respective patterns; and the timing to form an image on the photosensitive element for each color is adjusted. So, the positional deviation is corrected.

Control Example 2

Figure 34:
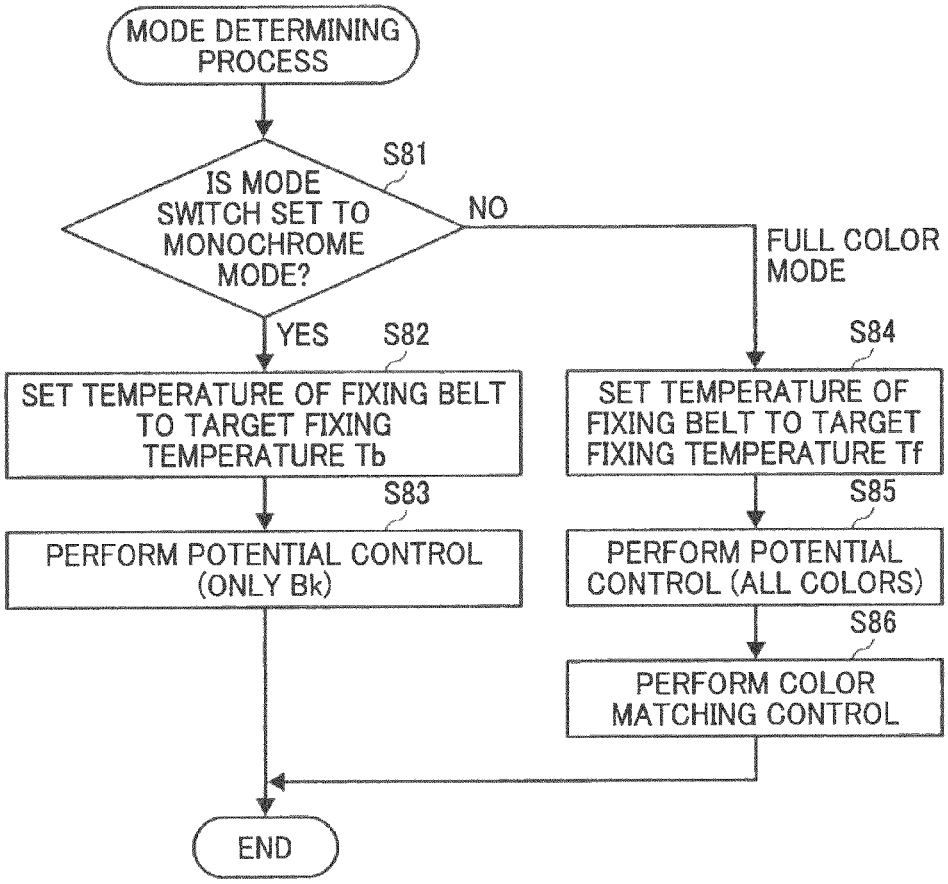
FIG. 34 is a flowchart illustrating an operation of Control example 2 according to the third embodiment.

Next, Control example 2 will be described with reference to a flowchart shown in FIG. 34.

In order to determine a mode, first, it is checked whether a monochrome mode is turned on when the power supply unit of the image forming apparatus is turned on (Step S81). If a monochrome mode is turned on here, the color matching adjustment is not performed and the above-mentioned potential control is performed only in the black image forming section. In this case, the image forming sections other than the black image forming section do not operate; and the toners other than black toner are not consumed. Accordingly, it may be possible to prevent consumption of the toners other than black toner and to prevent wearing and degradation of parts.

Further, control is performed so that the temperature of a fixing belt provided in the fixing device 30 becomes a target fixing temperature Tb (Step S82) at the same time as the above. This control is performed by controlling the fixing heater 23 on the basis of a detected value of the fixing temperature detecting sensor 21 as described above (see FIG. 32). Subsequently, potential control for forming a monochrome image is performed (Step S83).

Meanwhile, when it is determined such that the mode is a full color mode by the determination of a mode (if a full color mode is turned on), the above-mentioned potential control and color matching adjustment are performed in the image forming sections corresponding to the respective colors as performed in the image forming apparatus of the related art. Further, control is performed in a manner such that the temperatures of the fixing belts provided in the fixing devices 30 become a target fixing temperature Tf (Steps S84 to S86).

A relation between the target fixing temperature Tb of a monochrome mode and the target fixing temperature Tf of a full color mode satisfies "Tb≦Tf." In a monochrome mode, a fixing temperature is low and thus unnecessary waste of power can be suppressed.

Control Example 3

Next, a control operation (Control example 3) that is performed when an image forming apparatus returns from a standby state will be described. Here, the standby state means a state where power supplied to the image forming apparatus is interrupted partially or reduced; and the image forming apparatus waits a return command when an unused state of the image forming apparatus is kept for a predetermined time after a power supply unit is turned on, and also includes a state called an energy saving mode that is useful for power saving. The return means turning to a state where power necessary to form an image is supplied from the power supply unit and an image can be formed.

If some operations are requested when the image forming apparatus is in the standby state in which examples of the operations include manipulation of a key of an operational part of the image forming apparatus, copying, printing output, reception and transmission of a FAX, manipulation of a scanner, and the like, then a return operation is started. Further, even when some abnormalities such as jams occur or supply of power is partially stopped, then a return operation is started after the abnormalities are recovered. After that, since the operations that are to be performed after the determination of a mode are the same as those that are performed after the turning-on of the power supply unit as described with reference to FIG. 34, accordingly the description thereof will not be repeated.

Figure 35:
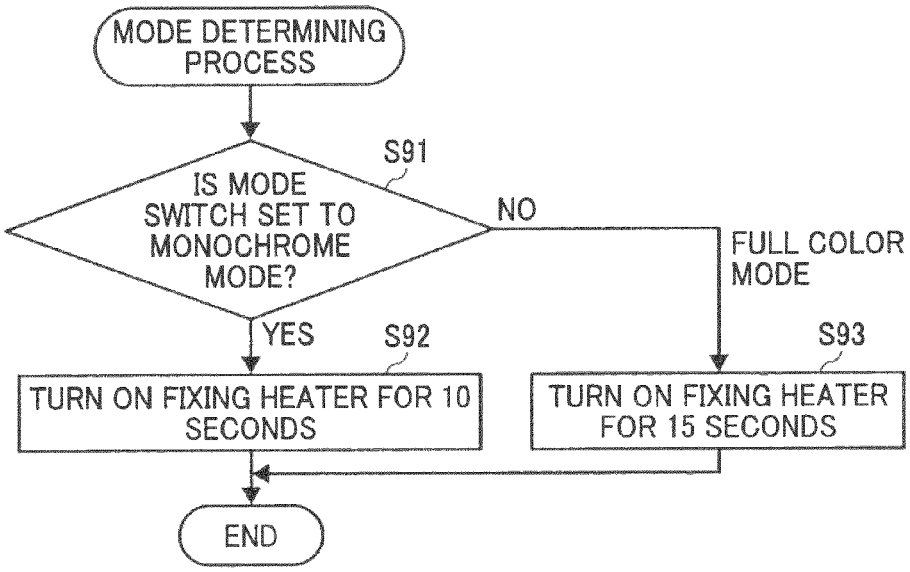
FIG. 35 is a flowchart illustrating an operation of Control example 3 according to the third embodiment.

A fixing operation performed when an image forming apparatus returns from a standby state is illustrated in a flowchart of FIG. 35. Here, when a return operation is to be performed, first a mode is determined (Step S91). In a monochrome mode, for example, a fixing heater is turned on for 10 seconds (Step S92). Meanwhile, in a full color mode, for example, the fixing heater is turned on for 15 seconds and the image forming apparatus returns to a state where printing can be performed (Step S93).

In a monochrome mode, an image is formed in a single color, that is, black. Accordingly, the amount of a toner adhered to a recording medium (sheet P) in a monochrome mode is smaller than that in a full color mode in which respective colors are superimposed to form an image. Therefore, the amount of heat required to fix a toner in a monochrome mode is smaller than that in a full color mode.

For this reason, in terms of the amount of heat that is required when a fixing device returns to a return state from a standby state, the heat in a monochrome mode is smaller than that in a full color mode. Accordingly, it may be possible to shorten a return time. Accordingly, it may be possible to suppress power consumption and thereby to reduce an environmental load.

Control Example 4

Figure 36:
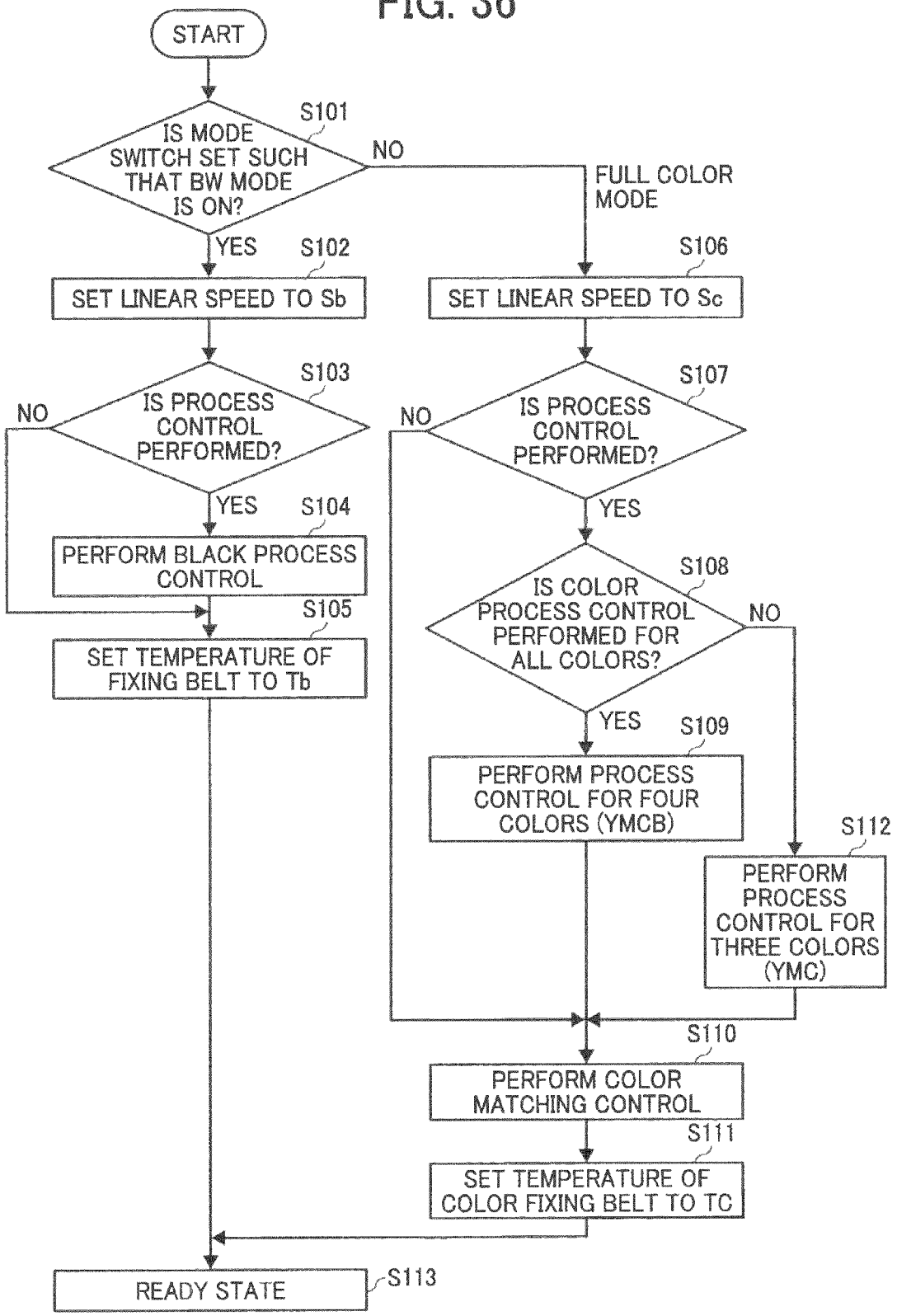
FIG. 36 is a flowchart illustrating an operation of Control example 4 according to the third embodiment.

Next, Control example 4 will be described with reference to a flowchart shown in FIG. 36.

First, it is determined whether the mode switch 60 is set to a monochrome mode or a full color mode (Step S101). Here, when a monochrome mode is turned on, the linear speed of a sheet is set to a monochrome condition (monochrome linear speed: Sb) where the linear speed of a sheet is higher than that in a full color mode so as to increase productivity (Step S102). Subsequently, it is determined whether it is necessary to perform the process control (Step S103). If it is determined that the process control needs to be performed, the black process control is performed to maintain good image quality (Step S104) and the temperature of a fixing belt is set to a fixing temperature (Tb) of a monochrome mode, so that every preparation is made (Step S105). The linear speed of a sheet is changed by the control of a photosensitive element motor or a motor of a conveying system (see FIG. 32). The value of the linear speed of a sheet in each mode is previously stored in the ROM of the control unit 37.

In this case, since power is not supplied to the Y, M, and C color image producing units, consumption of expandable supplies such as a toner that is usually consumed during the process control does not occur, which is advantageous in terms of cost.

Further, omission of the process control does not cause any problem at all in many cases if just merely a time less than half a day elapsed from the previous use and there is nearly no change in environmental conditions. Accordingly, the process control may not be selected.

If the process control is not to be performed in Step S103, the procedure proceeds to Step S105.

Meanwhile, if a full color mode is turned on in Step S101, the linear speed of a sheet is set to be as a full color condition (full color linear speed: Sc) (Step S106). Subsequently, it is determined whether it is necessary to perform the process control (Step S107). If it is determined such that the process control needs to be performed, it is further determined whether it is necessary to perform the color process control for all colors (Step S108). If it is determined that the process control needs to be performed for all colors, full color process control is performed to maintain good image quality (Step S109). In this case, if a time less than half a day elapsed from the time of black use and there is nearly no change in environmental conditions, omission of the black process control does not cause any problem at all in many cases. Accordingly, it is determined whether to perform the color process control for all colors or for colors except for black.

Subsequently, the above-mentioned color matching control for respective colors is performed (Step S110), and the temperature of a fixing belt is set to a fixing temperature (Tc) of a full color mode, so that every preparation has been made (Step S111).

If it is not necessary to perform the process control in Step S107, the procedure proceeds to Step S110.

If it is not necessary to perform the color process control for all colors in Step S108, the color process for only three colors (Y, C, and M) is performed (Step S112).

After the operation of Step S105 is performed and the operation of Step S111 is performed, the image forming apparatus enters a ready state (Step S113).

As described above, it may be possible to reduce consumption of color toners by the omission of the preparation operation of the apparatus for a color mode.

Since the thickness of a toner layer in a black mode is smaller than that in a full color mode, the amount of heat supplied to melt the toner layer in a black mode is smaller than that in a full color mode. Accordingly, the amount of heat required for fixing in a black mode is smaller than that in a full color mode. For this reason, in the case of a black mode, it may be possible to enlarge a linear speed area where a black toner can be fixed, to increase the linear speed, and to improve productivity.

Since it is satisfactory that the amount of heat supplied to melt the toner layer is small in the fixing of a black mode and the set temperature of the fixing roller is set to be low, energy is saved.

When the switch is switched to a full color mode from a black mode, if the process control is performed for all colors including black, it is possible to improve color image quality.

In the case in which the switch is switched to a full color mode from a black mode, if it is possible to select whether or not to perform the process control for all colors including black, it may be possible to reduce the toner consumption by omitting the process control when a fine color tone does not care (when there is just a color, and the like).

When the switch is switched to a full color mode from a black mode, it may be possible to reduce the consumption of black toner by performing the process control for colors other than black.

In the case in which the switch is set to a black mode, if it is possible to select whether or not to perform the process control for black, it may be possible to reduce the consumption of the black toner that is incurred by the adjustment of image quality, by omitting the process control.

Further, color deviation adjustment and density adjustment operations are performed in the same manner as those mentioned above with reference to FIG. 16. Accordingly, the description thereof will not be repeated here.

Although each of the above embodiments is explained with an exemplary structure of the intermediate transfer type image forming apparatus where a monochrome image producing unit is juxtaposed with color image producing units. However, the invention may be applied to a direct transfer type image forming apparatus or an image forming apparatus where a monochrome image producing unit is independent of the color image producing units.

Furthermore, in each of the above embodiments, explained is the application for an electrophotographic image forming apparatus, which forms an electrostatic latent image on a photosensitive element. However, it can be applied to an ink jet type image forming apparatus and the like.

The characteristics and the like of the above-mentioned third embodiments will be collectively described below.

First, an image forming apparatus has a monochrome mode and a full color mode as image forming modes, and a power supply unit of the image forming apparatus is turned on and off by a main power switch. The main power switch and a mode switching unit for selectively and manually switching a mode between a monochrome mode and a full color mode are integrally formed as one mode switch. The image forming apparatus has a structure that interrupts the power supplied to parts that are necessary to form an image in modes other than a monochrome mode when the mode switch is set to a monochrome mode. Further, the image forming apparatus includes an image forming condition changing unit for changing image forming conditions according to the difference of a mode.

Second, in the image forming apparatus, the mode switch can be arbitrarily set to any one of a power-off mode position where the power supply unit of the image forming apparatus is turned off; a monochrome mode position that is one of power-on positions; and a full color mode position that is one of the power-on positions.

Third, in the image forming apparatus, control of color deviation adjustment is not performed if the mode switch is set to a monochrome mode when power is supplied.

Fourth, in the image forming apparatus, a control target value of the amount of adhered toner is set to be lower than that in a full color mode when the mode switch is set to a monochrome mode.

Fifth, in the image forming apparatus, an interval of the controls of the amount of adhered toner is set to be longer than that in a full color mode when the mode switch is set to a monochrome mode.

Sixth, in the image forming apparatus, a target fixing temperature varies depending on modes when the mode is switched.

Seventh, in the image forming apparatus, in the case in which the potential control is performed when power is supplied, if the state at the time of power inputting is a monochrome mode state, the potential control is performed for only a monochrome image producing unit that operates in a monochrome mode.

Eighth, when the image forming apparatus returns from a waiting state to an operation state, the target fixing temperatures of a monochrome mode and a full color mode are changed in the image forming apparatus.

Ninth, in the image forming apparatus, in the case in which the potential control is performed when the apparatus returns from a standby state, if the standby state is in a monochrome mode, the potential control operation is performed for only a monochrome image producing unit that operates in a monochrome mode.

Tenth, in the image forming apparatus, in the case in which the control of color deviation adjustment is performed when the apparatus returns from the standby state, if the standby state is in a monochrome mode, the control of color deviation adjustment is not performed.

Eleventh, in the image forming apparatus, the linear speed of a sheet in a monochrome mode is set to be higher than that in a full color mode.

Twelfth, in the image forming apparatus, a target fixing temperature in a monochrome mode is set to be lower than that in a full color mode.

Thirteenth, in the image forming apparatus, the control of the amounts of adhered toners corresponding to all colors including black is performed when the mode switch is switched to a full color mode from a monochrome mode.

Fourteenth, in the image forming apparatus, it is possible to select whether or not to perform the control of the amounts of adhered toners corresponding to all colors including black when the mode switch is switched to a full color mode from a monochrome mode.

Fifteenth, in the image forming apparatus, the control of the amounts of adhered toners corresponding to all colors other than black is performed when the mode switch is switched to a full color mode from a monochrome mode.

Sixteenth, in the image forming apparatus, it may be possible to select whether or not to perform the control of the amount of adhered toner corresponding to black when the mode switch is set to a monochrome mode.

Accordingly, according to the image forming apparatus having the above-mentioned features, it may be possible to usually cope with monochrome documents, which are most of output documents, and to make color outputs when color outputs are necessarily needed. Therefore, it may be possible to provide an image forming apparatus that may not perform the unnecessary correction of positional deviation and density adjustment for respective colors, suppress the generation of adjustment time and unnecessary toner consumption, prevent the degradation of units, and efficiently form a color image.

According to the invention, it enables the image forming apparatus to normally cope with monochrome documents, which are most of output documents, and to produce a color output only when it is actually necessary. Therefore, it may be possible to obtain an advantage of providing an image forming apparatus that may not perform the unnecessary correction of positional deviation and density adjustment for respective colors; suppress the generation of adjustment time and unnecessary toner consumption, prevent the degradation of respective units; and efficiently form a color image.

Further, it may be possible to achieve further reduction in toner consumption, energy saving, reduction in waiting time, improvement in productivity, suppression in consumption and degradation of parts, reduction in running costs, and the like.

What is claimed is:

1. An image forming apparatus that has a monochrome mode and a full color mode as image forming modes, comprising:

a power supply unit configured to supply power thereto;

a main power switch configured to turn on and off the power supply unit;

a mode switching unit configured to selectively and manually be switched between the monochrome mode and the full color mode, wherein the main power switch and the mode switching unit are integrally formed as one mode switch; and a power supply interrupting unit configured to interrupt power supply to a part that is necessary to form an image in a mode other than the monochrome mode, when the mode switch is set to the monochrome mode.

2. The image forming apparatus according to claim 1, further comprising:

a full color failure detecting unit configured to detect a failure of a color image producing unit that operates in the full color mode.

3. The image forming apparatus according to claim 1, further comprising:

an image forming condition changing unit configured to change an image forming condition depending on a difference between modes.

4. The image forming apparatus according to claim 1, wherein the mode switch can be set to any one of a power-off mode position where the power supply unit is turned off;

a monochrome mode position that is one of power-on positions; and a full color mode position that is another one of the power-on positions.

5. The image forming apparatus according to claim 4, wherein the monochrome mode position is set between the power-off mode position and the full color mode position, and switching of the mode switch to the full color mode position from the monochrome mode position requires two or more different operations.

6. The image forming apparatus according to claim 4, wherein the monochrome mode position is set between the power-off mode position and the full color mode position, and switching of the mode switch to the full color mode position from the monochrome mode position is performed so that an operation direction of the mode switch is different.

7. The image forming apparatus according to claim 1, further comprising:

a mode switching mechanism that turns on and off of the power supply unit, the monochrome mode, and the full color mode; and a control unit that detects a switching position of the mode switch so as to control the mode switching mechanism.

8. The image forming apparatus according to claim 5, further comprising:

a monochrome mode automatic switching unit configured to automatically switch the mode switch to the monochrome mode position from the full color mode position, wherein the switching of the mode switch to the monochrome mode position from the full color mode position is performed by one operation or one kind of operation.

9. The image forming apparatus according to claim 8, wherein the monochrome mode automatic switching unit switches the mode switch to the monochrome mode from the full color mode after printing in the full color mode is finished.

10. The image forming apparatus according to claim 8, wherein the monochrome mode automatic switching unit switches the mode switch to the monochrome mode from the full color mode when a full color printing rate exceeds a predetermined value.

11. The image forming apparatus according to claim 4, wherein the power-off mode position is present between the monochrome mode position and the full color mode position, and the mode switch is switched by way of the power-off mode position when the mode switch is switched to the full color mode from the monochrome mode and when the mode switch is switched to the monochrome mode from the full color mode.

12. The image forming apparatus according to claim 1, further comprising:

a display unit configured to display a state of the image forming apparatus among the power-off mode, the monochrome mode, and the full color mode.

13. The image forming apparatus according to claim 7, wherein when the mode switch is switched to the monochrome mode position from the full color mode position during a printing job in the full color mode, an ON state of the full color mode is maintained until completion of the printing job in the full color mode and then the full color mode is turned off and the monochrome mode is turned on after completion of the printing job.

14. The image forming apparatus according to claim 7, wherein when the mode switch is switched to the monochrome mode position from the full color mode position during a printing job in the full color mode, the full color mode is turned off and the monochrome mode is turned on after completion of a portion of the printing job which is performed in the full color mode at the time of mode changing, and the remaining portion of the printing job originally scheduled to be performed in the full color mode is then to be performed in the monochrome mode.

15. The image forming apparatus according to claim 7, wherein when the mode switch is switched to the monochrome mode position from the full color mode position during a printing job in the full color mode, all image producing units including a black image producing unit are temporarily stopped after completion of a portion of the printing job which is performed in the full color mode at the time of mode changing, and then a message is displayed to allow a user to select whether to terminate the remaining portion of the printing job, to perform printing in the full color mode, or to perform printing in the monochrome mode.

16. The image forming apparatus according to claim 7, wherein when the mode switch is switched to the full color mode position from the monochrome mode position during a printing job in the monochrome mode, adjustment operations of color image producing units are performed during the printing job in the monochrome mode after the mode switch is switched.

17. The image forming apparatus according to claim 1, wherein when the mode switch is set to the monochrome mode, a linear speed of a sheet is set to be higher than that in the full color mode.

18. The image forming apparatus according to claim 1, wherein when the mode switch is set to the monochrome mode, a target fixing temperature is set to be lower than that in the full color mode.

19. The image forming apparatus according to claim 1, further comprising:

a plurality of image carriers that correspond to colors including black, respectively;

a plurality of developing devices that receive developers used to develop latent images formed on the respective image carriers and are provided corresponding to the respective image carriers;

an intermediate transfer body to which developed toner images are transferred; and a transfer conveying unit configured to convey a transfer material while contacting with the intermediate transfer body and the image carrier corresponding to black, wherein the image carriers and the developing devices, which correspond to the colors other than black, are disposed so as to transfer the developed toner images to the intermediate transfer body and the image carrier and the developing device, which correspond to black, are disposed independently of the intermediate transfer body, so that the toner image, which is formed on the image carrier corresponding to black, is directly transferred to the transfer material, wherein the toner image, which is formed on the image carrier corresponding to black, and the toner images, which are formed on the intermediate transfer body, are transferred to the transfer material in a superimposed manner, and wherein the intermediate transfer body belongs to parts that are necessary to form an image in a mode other than the monochrome mode.

20. The image forming apparatus according to claim 19, further comprising:

a sensor that detects adhesion state of the toner image formed on the intermediate transfer body, wherein when the mode switch is switched to the full color mode position from the monochrome mode position during a printing job in the monochrome mode, the adjustment operations of the color image producing units are performed during the printing job in the monochrome mode after the switch is switched, and wherein the adjustment operations include forming color toner image on the intermediate transfer body and feeding back detection result of the color toner image by the sensors to image forming condition.

* * * * *